US010011376B2

(12) United States Patent
Shinohara et al.

(10) Patent No.: US 10,011,376 B2
(45) Date of Patent: Jul. 3, 2018

(54) PACKAGING CONTAINER

(75) Inventors: Mitsuhiko Shinohara, Tokushima (JP); Takafumi Kawano, Tokushima (JP); Motokazu Kawano, Tokushima (JP); Masahar Kanai, Tokushima (JP); Toshiro Watanabe, Tokushima (JP); Mikio Ishimoto, Tokushima (JP); Shin-Ichi Hoshi, Tokyo (JP); Shin-Ichiro No, Tokyo (JP)

(73) Assignee: KABUSHIKI KAISHA YAKULT HONSHA, Tokyo (JP)

( * ) Notice: Subject to any disclaimer, the term of this patent is extended or adjusted under 35 U.S.C. 154(b) by 2582 days.

(21) Appl. No.: 11/886,306

(22) PCT Filed: Mar. 10, 2006

(86) PCT No.: PCT/JP2006/004708

§ 371 (c)(1),
(2), (4) Date: Jun. 24, 2008

(87) PCT Pub. No.: WO2006/098231

PCT Pub. Date: Sep. 21, 2006

(65) Prior Publication Data

US 2009/0212060 A1 Aug. 27, 2009

(30) Foreign Application Priority Data

Mar. 14, 2005 (JP) ..... 2005-071471

(51) Int. Cl.
*B65D 6/40* (2006.01)
*B65B 7/28* (2006.01)
*B65D 77/20* (2006.01)

(52) U.S. Cl.
CPC ..... *B65B 7/285* (2013.01); *B65D 77/2024* (2013.01)

(58) Field of Classification Search
CPC ..... B65D 6/40; B65D 77/2024; B65B 7/285
(Continued)

(56) References Cited

U.S. PATENT DOCUMENTS 2,521,523 A * 9/1950 Kemper ..... 222/571
2,620,938 A * 12/1952 Jesnig ..... 215/254
(Continued)

FOREIGN PATENT DOCUMENTS

EP 0 657 366 A1 6/1995
GB 401631 A * 8/1933
(Continued)

OTHER PUBLICATIONS

Extended European Search Report dated Apr. 2, 2009. Issued in PCT/JP2006/304708.
(Continued)

*Primary Examiner* — Andrew Perreault
(74) *Attorney, Agent, or Firm* — Venable LLP; Jeffri A. Kaminski

(57) ABSTRACT

It is to provide a packaging container comprising: a synthetic resin container body having a flange part at a periphery of an opening at an upper end thereof; and a container cap having a top board part and a skirt part provided such that it is suspended from a-periphery of the top board part, and wherein the top board part is heat-sealed onto an upper surface of the flange part of the container body; wherein the packaging container has a first cutout part at an upper end of an outer edge of the flange part. By providing a first cutout part, a packaging container possible to achieve sealing with the container cap stably, and to open the sealing easily and surely as well can be provided, by suppressing the effect of a molten resin on a folded corner part of the skirt of the container cap when the container body is heat-sealed with the container cap.

9 Claims, 15 Drawing Sheets

(58) Field of Classification Search
USPC ..... 220/359.1, 359.4, 359.5, 620; 215/DIG. 6, 232; 53/478, 477, 476, 485
See application file for complete search history.

(56) References Cited

U.S. PATENT DOCUMENTS

| | | | | | |
|---|---|---|---|---|---|
| 2,788,161 | A | * | 4/1957 | Kemper | 222/571 |
| 3,428,208 | A | * | 2/1969 | Kosar | 220/288 |
| 3,532,244 | A | * | 10/1970 | Yates, Jr. | 215/272 |
| 3,559,833 | A | * | 2/1971 | Alonso | 215/44 |
| 3,655,084 | A | * | 4/1972 | Willhaus et al. | 215/232 |
| 3,770,156 | A | * | 11/1973 | Yates, Jr. | 215/250 |
| 3,815,771 | A | * | 6/1974 | Marks | 215/344 |
| 3,892,351 | A | * | 7/1975 | Johnson et al. | 220/359.4 |
| 4,044,941 | A | * | 8/1977 | Knudsen | 215/232 |
| 4,094,460 | A | * | 6/1978 | Scanga et al. | 215/232 |
| 4,109,815 | A | * | 8/1978 | Collins, III | 215/232 |
| 4,215,797 | A | * | 8/1980 | Chen | 220/359.4 |
| 4,378,892 | A | * | 4/1983 | Ochs et al. | 215/232 |
| 4,433,793 | A | * | 2/1984 | Ingemann | 220/276 |
| 4,472,219 | A | * | 9/1984 | Taira et al. | 220/359.4 |
| 4,529,100 | A | * | 7/1985 | Ingemann | 220/270 |
| 4,683,016 | A | * | 7/1987 | Dutt et al. | 156/69 |
| 5,040,357 | A | * | 8/1991 | Ingemann et al. | 53/478 |
| 6,079,579 | A | * | 6/2000 | De Cuyper | 215/41 |
| 2006/0124652 | A1 | * | 6/2006 | Ohtsuki et al. | 220/612 |
| 2007/0131639 | A1 | * | 6/2007 | Nakaya et al. | 215/232 |

FOREIGN PATENT DOCUMENTS

| | | | | |
|---|---|---|---|---|
| JP | 63-044466 | A | | 2/1988 |
| JP | 02-180168 | A | | 7/1990 |
| JP | 4-091878 | | | 8/1992 |
| JP | 11-10810 | | | 1/1999 |
| JP | 2002-225902 | | | 8/2002 |
| JP | 2003-291273 | A | | 10/2003 |
| JP | 2004-074794 | A | | 3/2004 |
| WO | WO 8907553 | A | * | 8/1989 |
| WO | WO-2004/011230 | | | 2/2004 |

OTHER PUBLICATIONS

Notification of Transmittal of Translation of the International Preliminary Report on Patentability.
English Translation of Written Opinion.
International Search Report dated Jun. 13, 2006, issued in PCT/JP2006/304708.

* cited by examiner

【Fig.1】
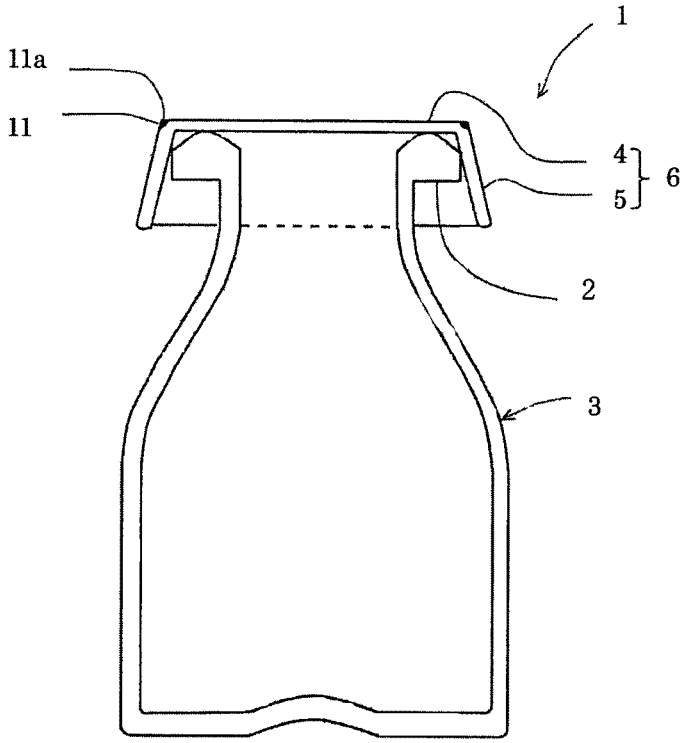
【Fig.2】
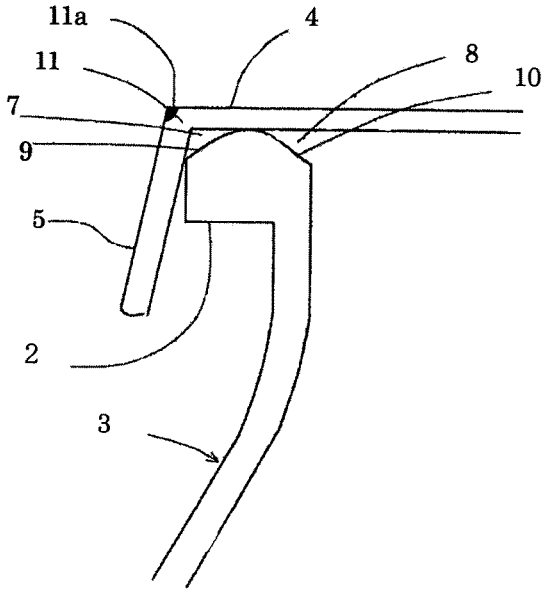

【Fig.3】
(A)
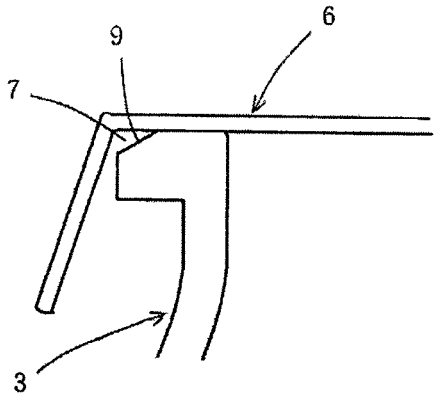
(B)
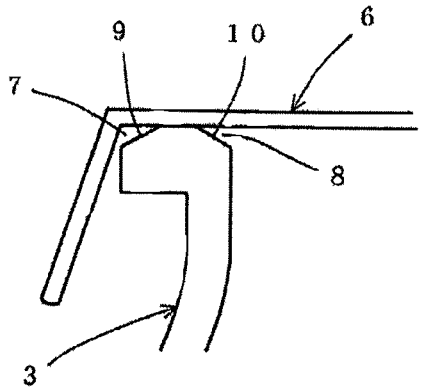
(C)
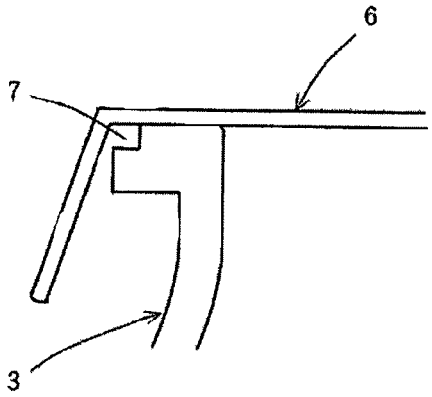

[Fig. 4]
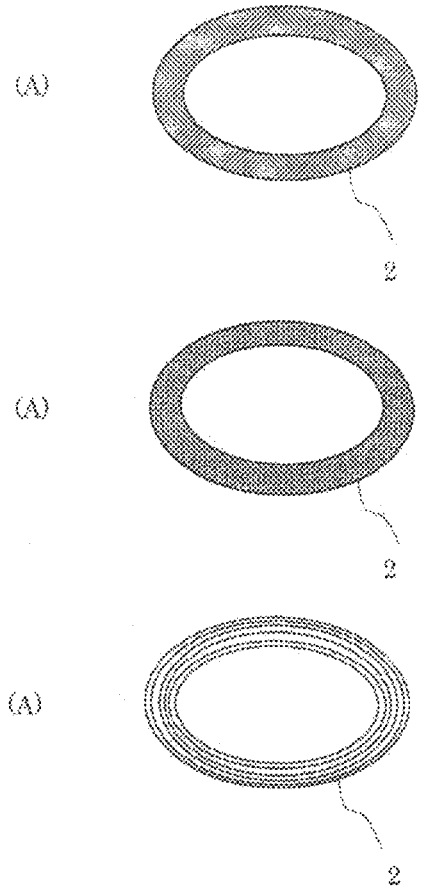
[Fig. 5]
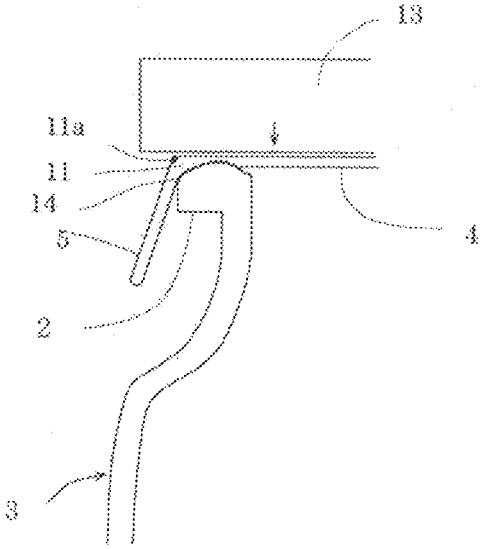

【Fig. 6】
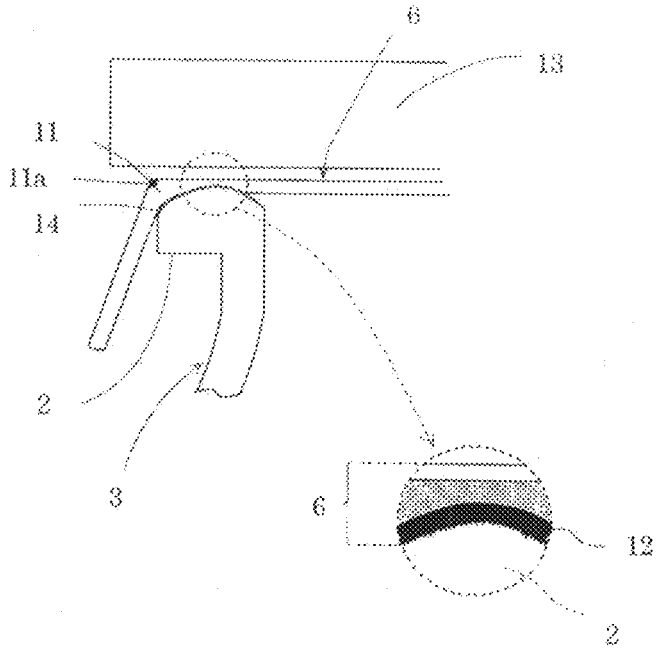
【Fig. 7】
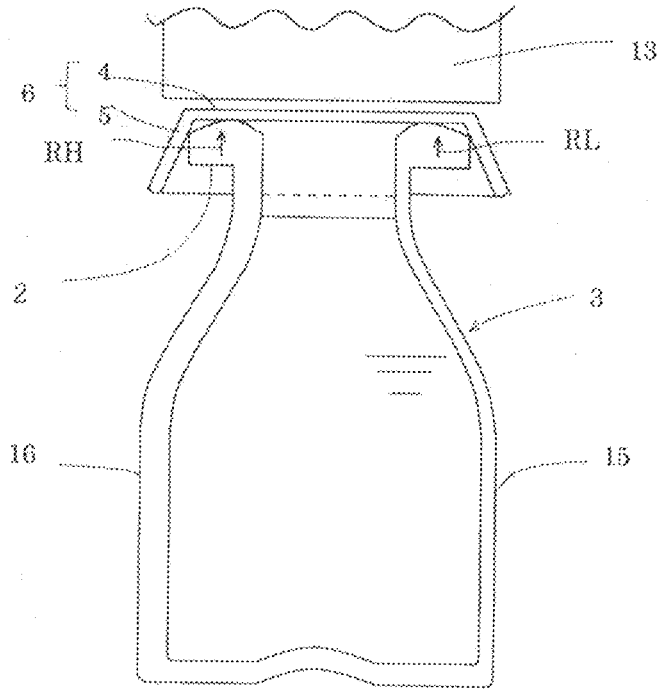

【Fig. 8】
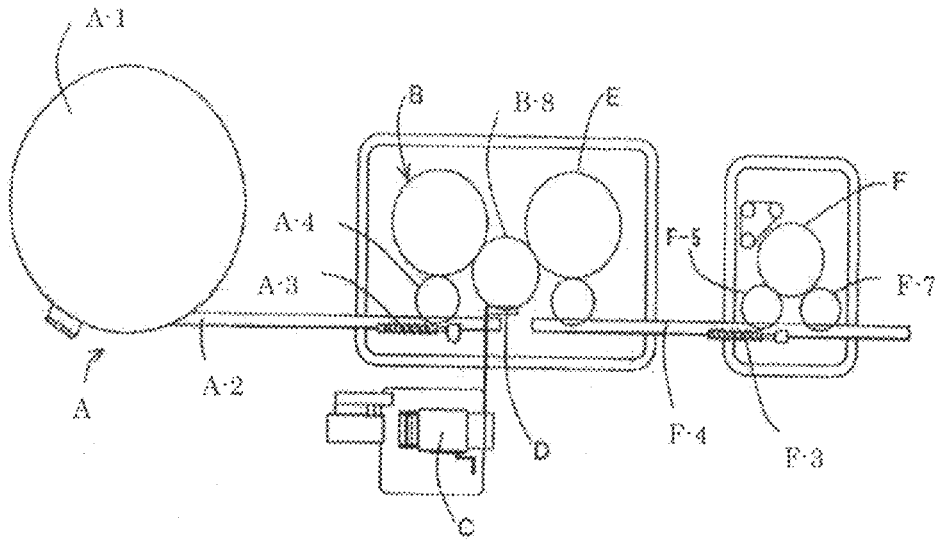
【Fig. 9】
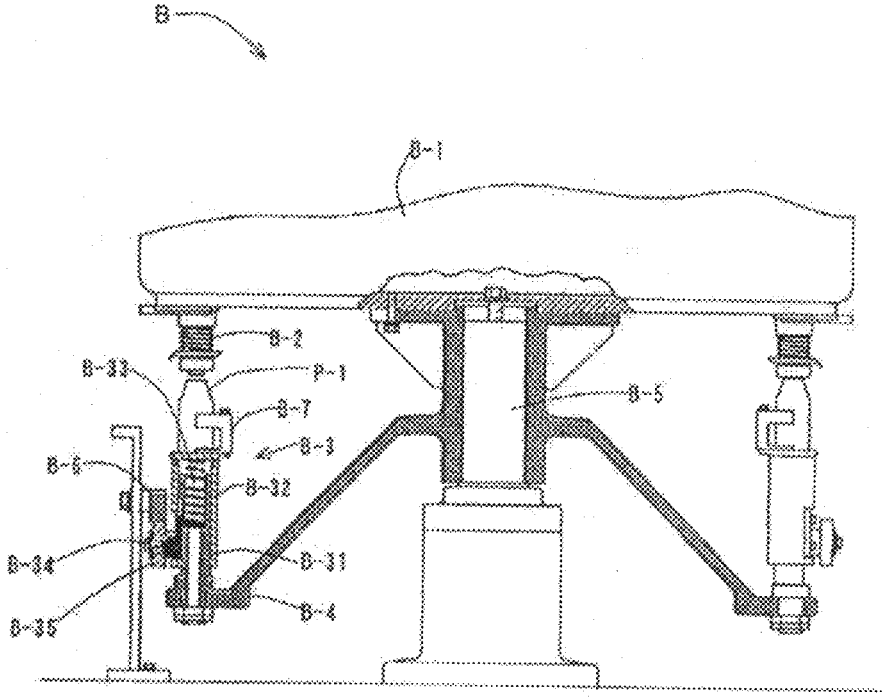

[Fig. 10]
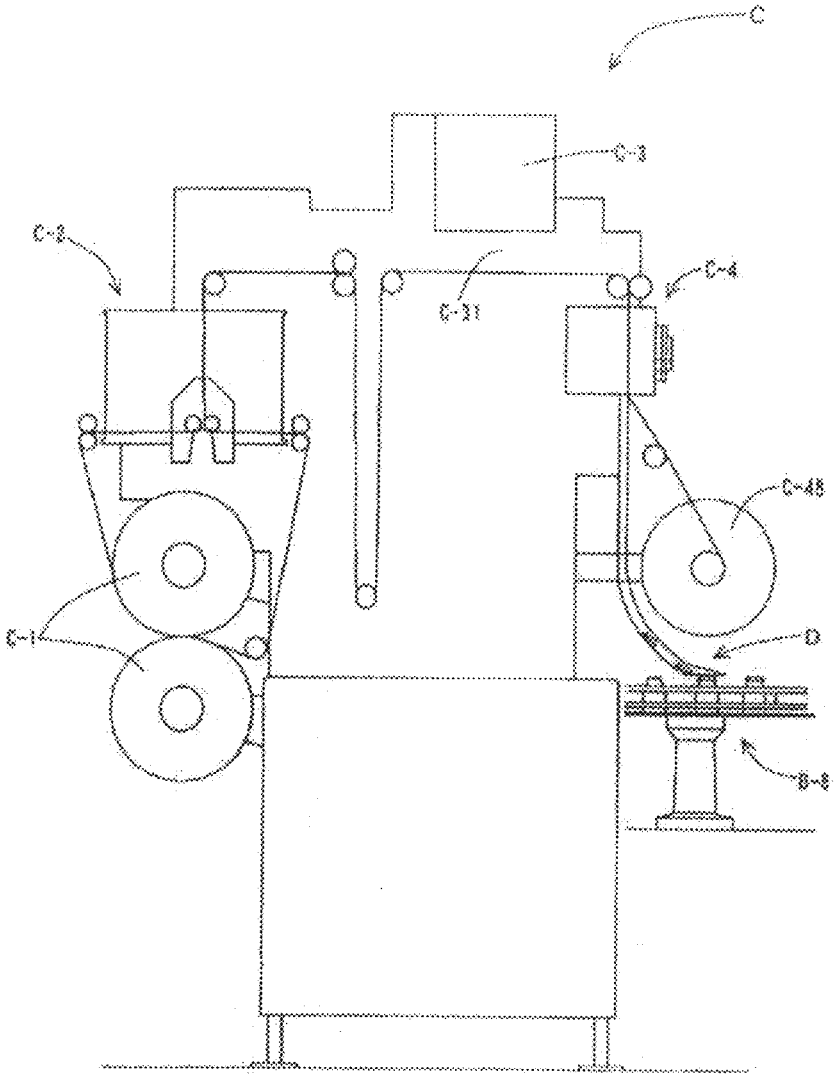

[Fig. 11]
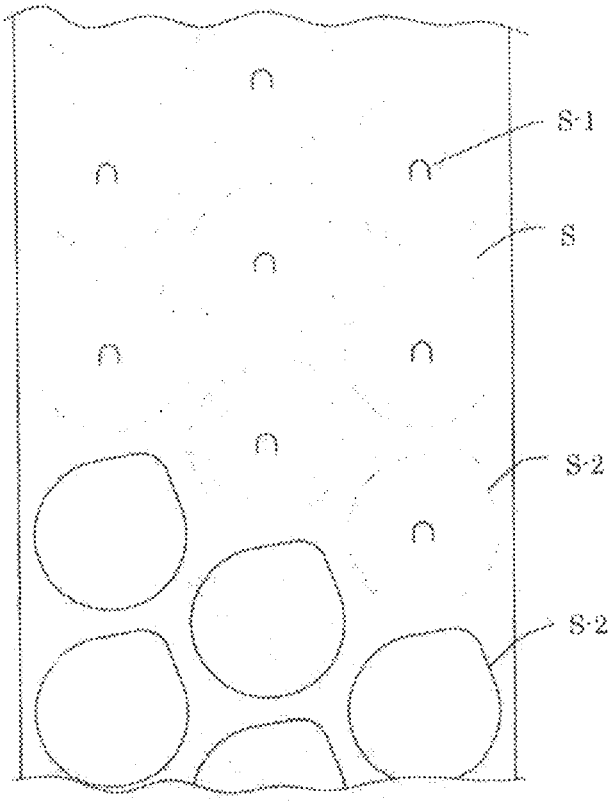

[Fig. 12]
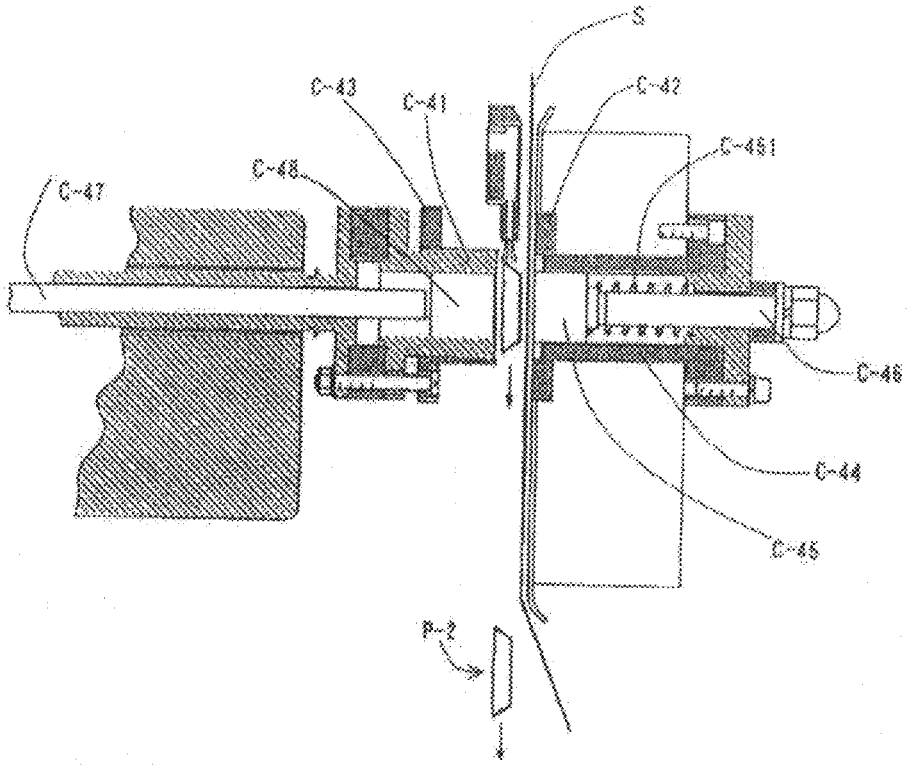

[Fig. 13]
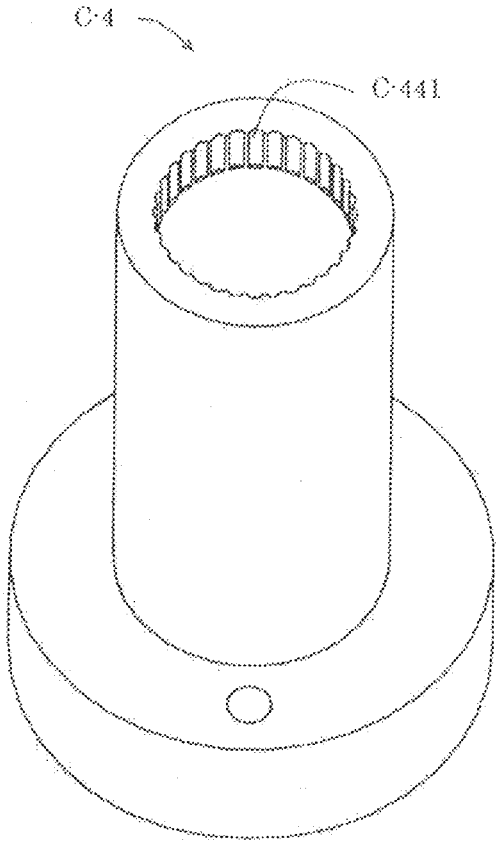
[Fig. 14]
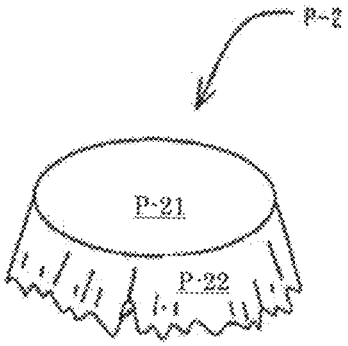

【Fig. 15】
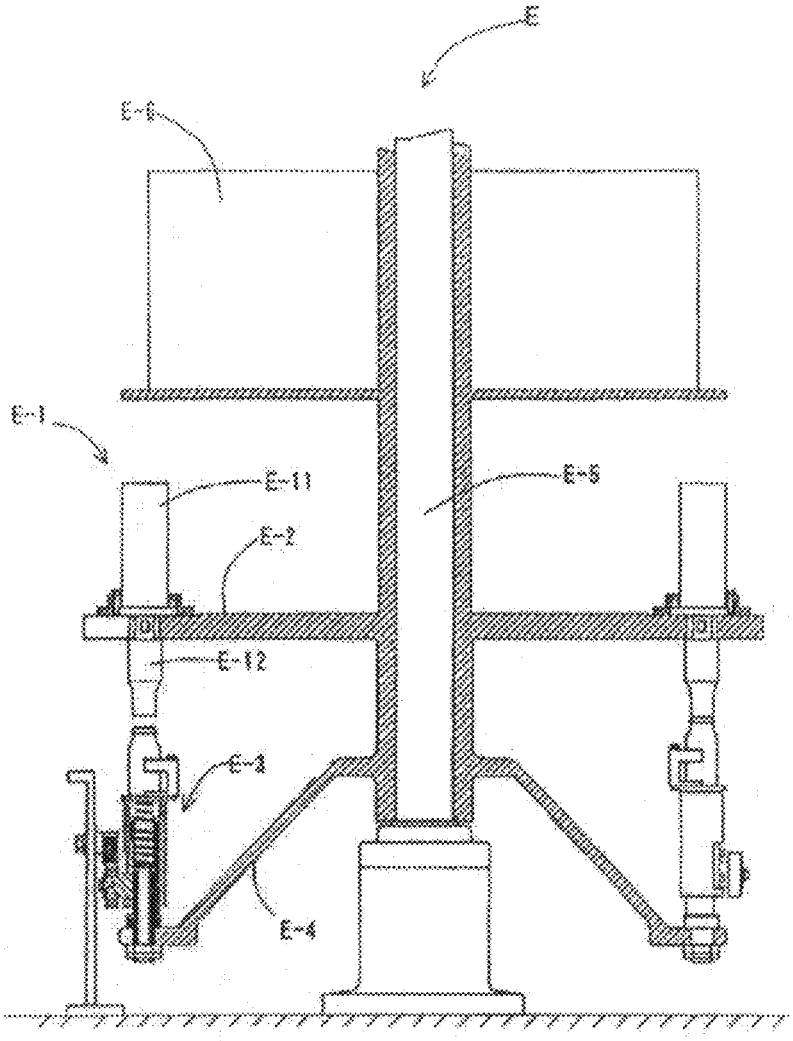

[Fig. 16]
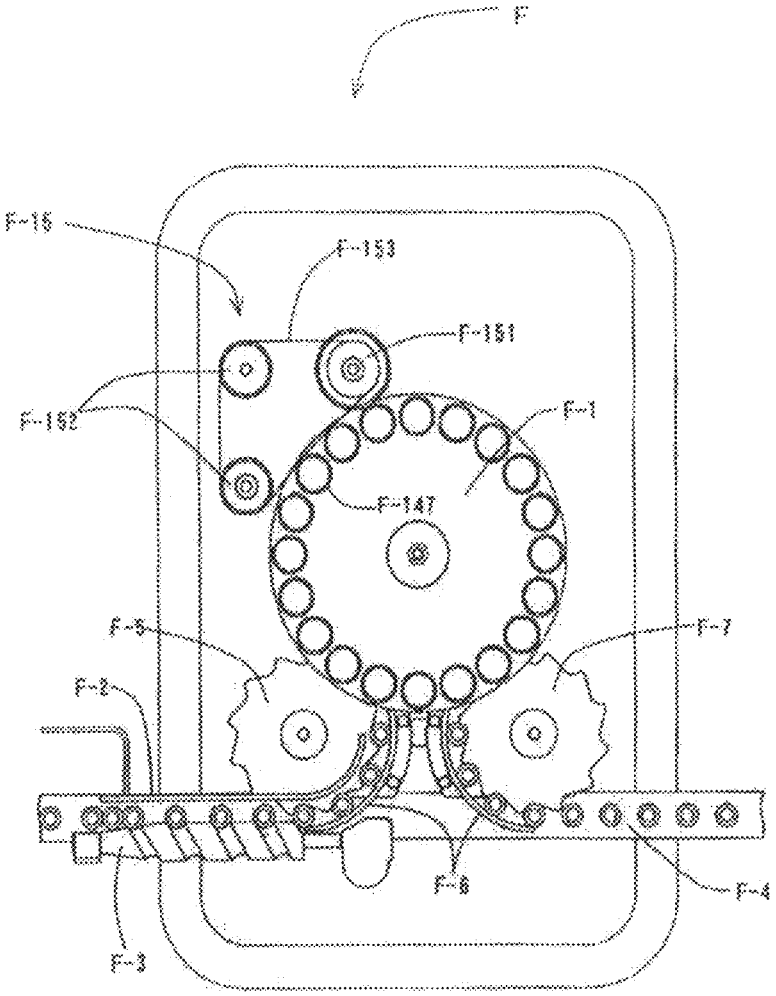

[Fig. 17]
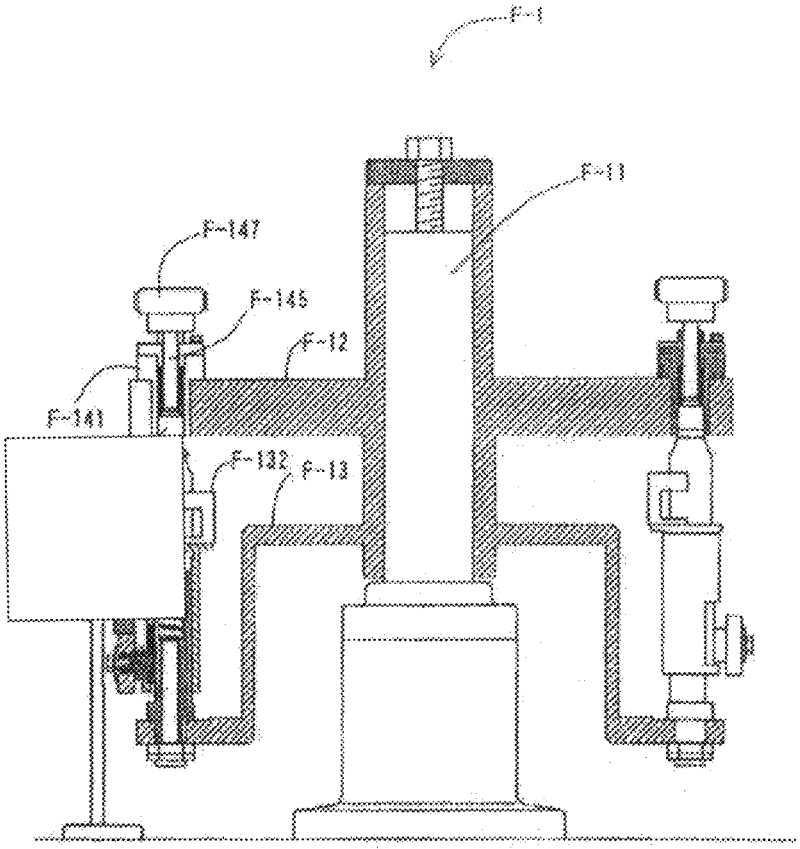
[Fig. 18]
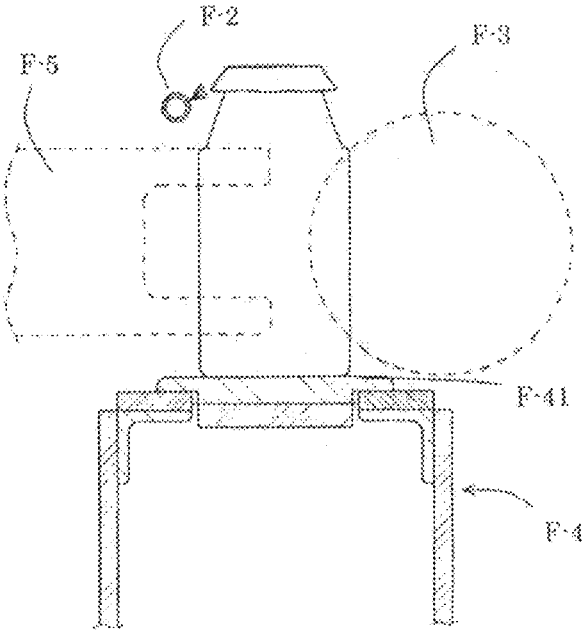

【Fig. 19】
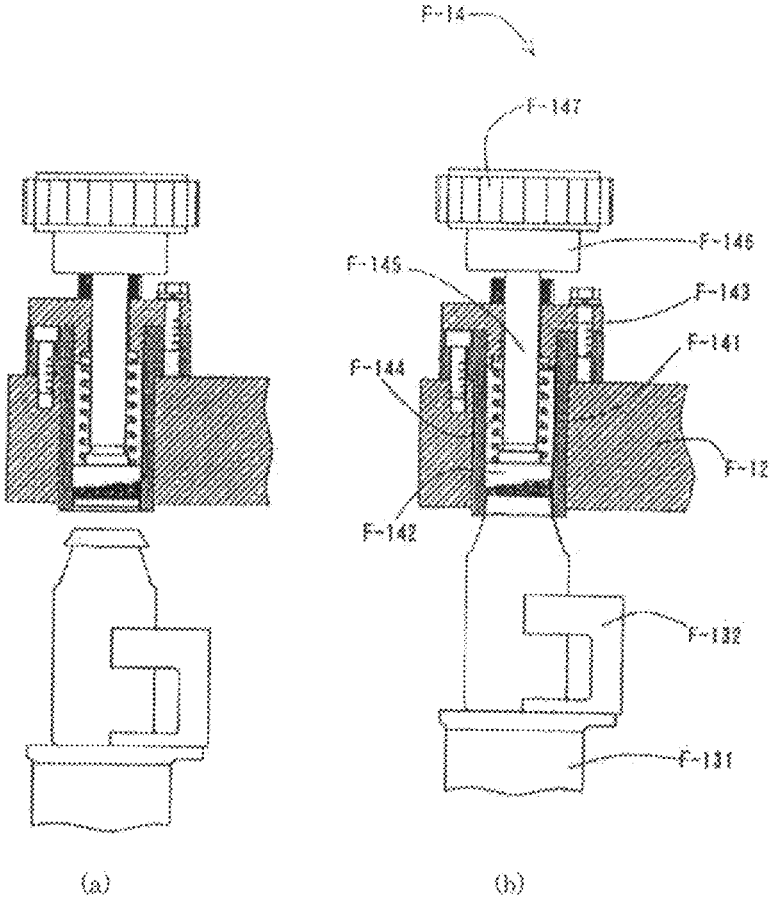

[Fig. 20]
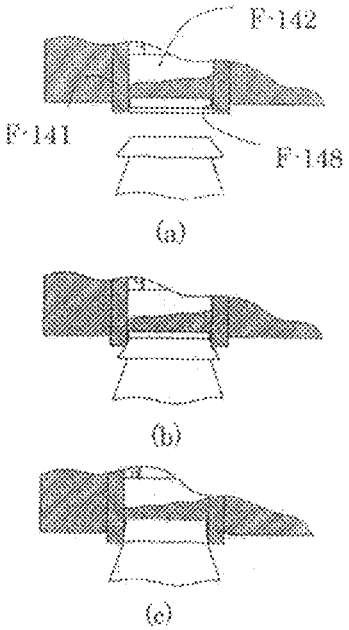

[Fig. 21]
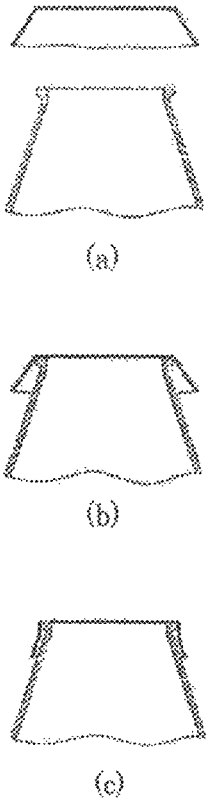
[Fig. 22] PRIOR ART
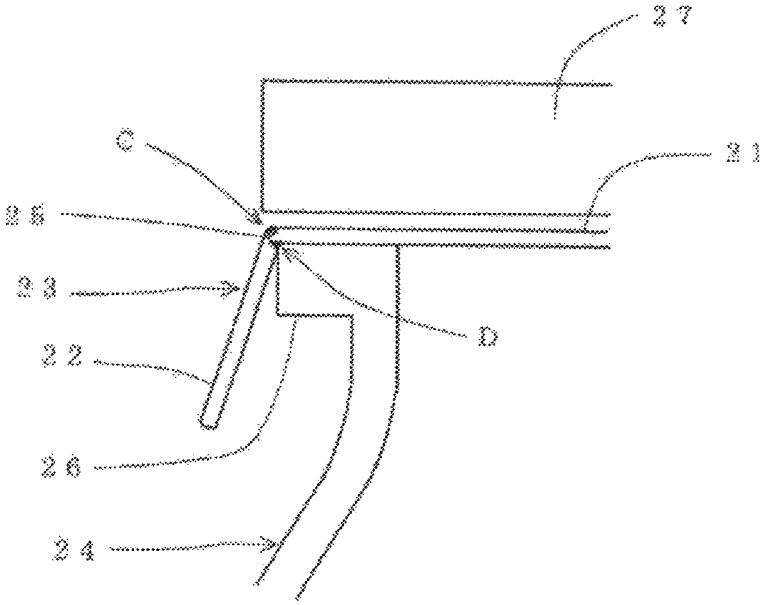

PACKAGING CONTAINER

TECHNICAL FIELD

The present invention relates to a packaging container comprising: a synthetic resin container body having a flange part at a periphery of an opening at an upper end thereof; and a container cap having a top board part and a skirt part provided such that it is suspended from a periphery of the top board part, and wherein the top board part is heat-sealed onto an upper surface of the flange part of the container body.

BACKGROUND ART

Conventionally, so-called general purpose polystyrene (GPPS)-based resin such as styrene homopolymer which is excellent in tensile strength, heat resistance, light resistance, formability and surface luster, and high impact polystyrene (HIPS) wherein rubber such as SBR and BR is blended with GPPS to reduce its brittleness, have been often used for food containers such as beverage containers, yoghurt containers, portion containers, cup noodle containers, and for synthetic resin containers to be filled with disposable medical supplies, etc. As a cap material to be put together and seal an opening of such polystyrene-based resin container, an aluminum laminated body wherein an aluminum foil is used as a base material, a sealant layer, etc., for adhering to the container are provided on its surface, is used. An aluminum cap, which is produced by forming a small piece of aluminum cap material being punched out into an extensive form of the cap from the aluminum laminated body thus described into a shape with a skirt by folding back its end, and with which an opening of a container is sealed, is commonly used because of the following reasons: it has an excellent sealing property, a peel resistant property, and excellent stability at the time of peeling; when it is fed to the opening of the container, it shows low level of adhesion caused by static electricity, and feedability of sheet is good. In addition, the aluminum cap has a so-called shape retaining property which is a property to maintain a folded and deformed shape when a skirt, which has been formed by folding back its peripheral part, is provided. Therefore, when drinking a filled beverage directly from the container, the state wherein the part in the vicinity of the opening of the container which comes into contact with the mouth is covered with the end of the cap, is well retained, and an area in the vicinity of the opening of the container can be prevented from getting dirty. It is thus hygienically excellent, and excellent in appearance as well. Therefore, it has been preferably used.

Further, as an alternative for the conventional aluminum cap thus described, a cap made of synthetic resin, has been proposed. For example, the followings have been proposed: a cap material manufactured by punching out a laminated material wherein a sealant layer is provided on the lower face of a laminated base material which has been constructed by laminating a heat-resistant film on both sides of a base material of a co-extruded film comprising a central layer constituted of high-density polyethylene and polypropylene-based polymer, and a coat layer constituted of high-density polyethylene, which is provided on both sides of the central layer, into a given shape (for example, see Patent Document 1); and a container for liquid comprising a container body having a mouth part, and a cap which closes the mouth part, wherein the whole of the container body and the cap is made of a synthetic resin (for example, see Patent Document 2). In addition, a resin sheet for cold forming that can be formed by cold-draw-forming has been proposed as a cap material of a packaging container (for example, see Patent Document 3).

Patent-Document 1: Japanese Laid-Open Patent Application No. 11-10810

Patent-Document 2: Japanese Laid-Open Patent Application No. 2002-225902

Patent-Document 3: Japanese Laid-Open Patent Application No. 2004-74794

DISCLOSURE OF THE INVENTION

An Object to be Solved by the Invention

As mentioned above, aluminum container caps and synthetic resin container caps have been used. However, in some cases, the following phenomena have been observed when container bodies are heat-sealed with such container caps: a folded corner part of a skirt of a container cap is ruptured and a hole is made; the rupture strength of a folded corner part of a skirt has significantly weakened, and as a result, that part is ruptured at the time of opening. In particular, such phenomena have occurred more frequently in synthetic resin container caps than in aluminum container caps.

In other words, as shown in FIG. 22, in case where a container body 24 is sealed with a container cap 23 having a skirt part 22 provided such that it is suspended from a periphery of a top board part 21, when an easy peel sealant being laminated on a cap material and a resin at the surface of a flange part 26 of the container body 24 are heated by a sealing member 27, and sealing pressure is applied to them, the resin at the surface of the sealant flange part 26 softens and protrudes to a radially outward direction (the part D in FIG. 22), resulting that the resin crushes through a folded corner part of a skirt 25 of the container cap 23 and causes a breakage at the edge. Even when such events do not occur, the rupture strength of the folded corner part of the skirt 25 has significantly weakened in some cases. Further, conventionally, the upper surface of the flange part 26 of the container body 24 is substantially flat and the sealing pressure is also applied to the folded corner part of the skirt 25 without reduction, and consequently, a heavy load is put on that part. Particularly in the container cap 23 formed by cold-draw-forming from a resin sheet for cold forming, as it is formed by plastically deforming the boundary part (the folded corner part of the skirt 25) between the top board part 21 and the skirt part 22, a part at the obverse side of the folded corner part of the skirt 25 is damaged (the part C in FIG. 22), and it is likely to cause the above-mentioned problems. There are problems such as: in case a hole has been made in the folded corner part of the skirt 25, the item is completely defective as a product; and in case the rupture strength of the folded corner part of the skirt 25 has weakened, the folded corner part of a skirt 25 is ruptured when opening the cap and only the top board part 21 of the container cap 23 is left sealed on the container body 24, resulting that products with poor openability are produced.

Further, in conventional packaging containers, localized deformation in a flange part frequently occurs when container bodies are taken out in the forming process of the container bodies, and the deformation volumes are not uniform. Therefore in some cases, the flange part and the container cap do not adhere to each other uniformly, causing a defect in sealing. Furthermore, the wall thickness of a container body, in particular, a container body made by blow molding, is not uniform. The wall thickness is usually uneven, and the thick-walled side of a container exhibits greater reaction force while the thin-walled side exhibits smaller reaction force, and there are variations in the seal strength because the greater the pressure is, the higher the value of seal strength is. In other words, it is difficult to achieve the sealing while supporting a part just below the flange part because the container cap has a skirt part; the whole container is compressed by the sealing pressure; and the sealed part as a whole does not achieve uniform seal strength. As a result, there has occurred the following problem: when easy peeling is fulfilled, drop strength is not fulfilled, on the other hand, when strong sealing is conducted to fulfill the drop strength, a breakage is caused at the edge at the time of opening.

The present invention has been made in view of the problems mentioned above, and the first object of the present invention is to provide a packaging container wherein sealing with a container cap can be stably achieved, and the sealing can be opened easily and surely, by suppressing the effect of a molten resin on a folded corner part of a skirt of the container cap. In addition, the second object of the present invention is to provide a packaging container wherein stable sealing can be achieved, and the sealing can be opened easily and surely, by preventing defects in sealing resulted from nonuniform shapes of the container bodies being produced when the container bodies are molded.

Means for Attaining the Object

In a lot of filling operations, defective products, for example, a product which has a hole in a part of its container cap, and a product whose container cap is partially ruptured at the time of opening, are occasionally produced. Therefore, the present inventors have made a keen study to improve such defects and as a result, have come to know a phenomenon wherein a folded corner part of a skirt, in particular, a folded corner part of a skirt at a thick-walled side of a container body is ruptured, and have found that the phenomenon is caused by the effect of the melting of a sealant resin of a cap body and the melting of a flange part. As a method for improving the phenomenon, the present inventors have found that ruptures of container caps can be suppressed by suppressing the direct contact of the molten sealant resin with the folded corner part of the skirt of the cap material, and by suppressing the pressure applied to the folded corner part of the skirt, as well. The present invention has been thus completed.

In other words, the present invention relates to: (1) a packaging container comprising: a synthetic resin container body having a flange part at a periphery of an opening at an upper end thereof; and a container cap having a top board part and a skirt part provided such that it is suspended from a periphery of the top board part, and wherein the top board part is heat-sealed onto an upper surface of the flange part of the container body; wherein the packaging container has a first cutout part at an upper end of an outer edge of the flange part; (2) the packaging container according to (1) mentioned above, which has a second cutout part at an upper end of an inner edge of the flange part; (3) the packaging container according to (1) or (2) mentioned above, wherein an outwardly inclined surface being inclined downward in a radially outward direction is formed at the upper surface of the flange part; (4) the packaging container according to (3) mentioned above, wherein a longitudinal cross section of the outwardly inclined surface is formed in a curved line; (5) the packaging container according to any one of (2) to (4) mentioned above, wherein an inwardly inclined surface being inclined downward in a radially inward direction is formed at the upper surface of the flange part; (6) the packaging container according to (5) mentioned above, wherein a longitudinal cross section of the inwardly inclined surface is formed in a curved line; (7) the packaging container according to (5) or (6) mentioned above, wherein the outwardly inclined surface and the inwardly inclined surface are contiguous, and a longitudinal cross section of the outwardly inclined surface and the inwardly inclined surface is formed in a circular arc; and (8) the packaging container according to (7) mentioned above, wherein a radius of curvature of the circular arc in the longitudinal cross section of the outwardly inclined surface and the inwardly inclined surface is 1 to 3-fold of the width of the flange.

The present invention also relates to: (9) the packaging container according to (5) or (6) mentioned above, wherein the outwardly inclined surface and the inwardly inclined surface are formed such that there is a horizontal plane between them; (10) the packaging container according to any one of (1) to (9) mentioned above, wherein a surface roughening is conducted to a whole or part of the upper surface of the flange part; (11) the packaging container according to (10) mentioned above, wherein the surface roughening is surface roughening in which arithmetic average roughness (Ra) as defined in JIS B 0601-1994 is 4 to 20 μm; (12) the packaging container according to any one of (1) to (11) mentioned above, wherein a container cap is made of a synthetic resin; (13) the packaging container according to (12) mentioned above, wherein the container cap is formed by cold-drawing from a resin sheet for cold forming; (14) the packaging container according to any one of (1) to (13) mentioned above, wherein the container body and the container cap are fixed by ultrasonic heat sealing; and (15) the packaging container according to any one of (1) to (14) mentioned above, wherein the thickness of the container cap is 50 μm to 1 mm.

The present invention further relates to: (16) a filled package comprising the packaging container according to any one of (1) to (15) mentioned above, and a filling being filled in the packaging container.

BRIEF DESCRIPTION OF DRAWINGS

FIG. 1 It is a longitudinal cross section of the packaging container of the present invention.

FIG. 2 It is a longitudinal cross section of the flange part and its vicinity of the packaging container shown in FIG. 1.

FIG. 3 (A) to (C) are a set of longitudinal cross sections of the flange part and its vicinity according to other example.

FIG. 4 (A) to (D) are a set of views showing examples of a geometry of a rough surface at the upper surface of the flange part.

FIG. 5 It is an explanatory view for the packaging container shown in FIG. 1 when it is sealed.

FIG. 6 It is an enlarged view of the flange part of FIG. 5.

FIG. 7 It is a view showing the unevenness in the thickness of the container body.

FIG. 8 It is an overall plan view of one embodiment of the filling/packaging machine to which the secondary cap forming device is applied.

FIG. 9 It is a longitudinal cross section of the filling device in the filling/packaging machine shown in FIG. 8.

FIG. 10 It is a schematic view of the primary cap cold forming device in the filling/packaging machine shown in FIG. 8.

FIG. 11 It is a plan view of the sheet-like cap material in the process of punching out caps in the primary cap cold forming device shown in FIG. 10.

FIG. 12 It is a longitudinal cross section of the cap punching-out and forming device in the primary cap cold forming device shown in FIG. 10.

FIG. 13 It is a perspective view of the forming die in the cap punching-out and forming device shown in FIG. 12.

FIG. 14 It is a perspective view of the cap formed by the primary cap cold forming device shown in FIG. 10.

FIG. 15 It is a longitudinal cross section of the sealing device in the filling/packaging machine shown in FIG. 8.

FIG. 16 It is a plan view of the secondary cap forming device in the filling/packaging machine shown in FIG. 8.

FIG. 17 It is a longitudinal cross section of the secondary cap forming device body in the secondary cap forming device shown in FIG. 16.

FIG. 18 It is a longitudinal cross section of the container on the transfer conveyor in the secondary cap forming device shown in FIG. 16.

FIG. 19 It is a longitudinal cross section of the forming and processing part in the secondary cap forming device body shown in FIG. 17.

FIG. 20 It is an enlarged longitudinal cross section of one end of the formed hole and its vicinity in the forming and processing part shown in FIG. 19.

FIG. 21 It is a longitudinal cross section showing the shape of a cap in the process of forming.

FIG. 22 It is an enlarged longitudinal cross section of the flange part and its vicinity of a conventional packaging container.

EXPLANATION OF LETTERS OR NUMERALS

1 packaging container
2 flange part
3 container body
4 top board part
5 skirt part
6 container cap
7 first cutout part
8 second cutout part
9 outwardly inclined surface
10 inwardly inclined surface
11 folded corner part of skirt
11*a* part at the obverse side
12 sealant part
13 sealing member
14 protrusion
15 thin-walled part
16 thick-walled part
A container feeding device
A-1 container setting-up device
A-2 transfer conveyor
A-3 screw conveyor
A-4 inlet star wheel
B filling device
B-1 filling liquid tank
B-2 filling nozzle
B-3 container placing table
B-31 fixed part
B-32 move part
B-33 spring
B-34 roller shaft
B-35 roller
B-4 turntable
B-5 drive shaft of filling device
B-6 cam
B-7 container holder
B-8 intermediate star wheel
C primary cap forming device
C-1 roll of cap material
C-2 automatic cap material feeding device
C-3 half-cutting forming device
C-31 laser
C-4 cap punching-out and forming device
C-41 movable blade (male blade)
C-42 fixed blade (female blade)
C-43 holding member
C-44 forming die
C-441 groove
C-45 cap pushing-back piston
C-451 spring
C-46 piston rod
C-47 operating rod for reciprocating former
C-48 former
C-5 recovery roll
D cap feeding device (chute)
E sealing device
E-1 ultrasonic sealing device
E-11 sealing device body
E-12 horn
E-2 upper turntable
E-3 container table
E-4 lower turntable
E-5 drive shaft of sealing device
E-6 controlling device
F secondary cap forming device
F-1 secondary cap forming device body
F-11 drive shaft
F-12 upper turntable
F-131 container table
F-132 container holder
F-14 forming and processing part
F-141 tubular female die
F-142 extrusion piston
F-143 spring holder
F-144 spring
F-145 piston rod
F-146 stopper
F-147 gear
F-148 setting-in recess
F-15 forming auxiliary part
F-151 driving pulley
F-152 driven pulley
F-153 synchronous belt
F-2 pipe-like hot air nozzle
F-3 screw conveyor
F-4 transfer conveyor
F-41 transfer belt
F-5 inlet star wheel
F-6 guide
F-7 outlet star wheel
S synthetic resin sheet-like cap material, packaging material
S-1 substantially U-shaped groove
P container
P-1 container body
P-2 cap
P-21 top board part (upper surface of cap)
P-22 skirt part
P-23 folded part

BEST MODE OF CARRYING OUT THE INVENTION

The packaging container of the present invention is not particularly limited as long as it is a packaging container comprising: a synthetic resin container body having a flange part at a periphery of an opening at an upper end thereof; and a container cap having a top board part and a skirt part provided such that it is suspended from a periphery of the top board part, and wherein the top board part is heat-sealed onto an upper surface of the flange part of the container body; wherein the packaging container has a first cutout part at an upper end of an outer edge of the flange part. Because it has a first cutout part at the upper end of the outer edge of the flange part, the packaging container of the present invention can prevent a rupture and a damage of a folded corner part of a skirt of a container cap by reducing the amount of a molten resin in the vicinity of the folded corner part of the skirt to suppress the effect of the molten resin on the folded corner part of the skirt, and by holding the molten resin from a radially inward direction in the cutout part to suppress the effect of the molten resin on the folded corner part of the skirt, as well. In other words, the following situation, which will occur in case this first cutout part is not provided, can be effectively prevented: a large amount of a sealant resin being laminated on a cap material melts and the trapped molten resin is extruded concentrically to the vicinity of a folded corner part of the skirt of the cap and, and the upper surface of the flange part of the container cap melts and is extruded to the vicinity of the folded corner part of the skirt, resulting that the molten resin protrudes to the folded corner part of the skirt. In addition, as the sealing pressure at the folded corner part of a skirt is reduced, a load to be put on that part is reduced. The rupture and the damage of the folded corner part of the skirt of the container cap can be prevented also by this process.

With regard to the shape and size of the first cutout part at the upper end of the outer edge of the flange part mentioned above, any shape and size can be applied as long as it does not make it impossible to seal the upper surface of the flange with the container cap. For example, cutout parts whose longitudinal cross sections are rectangle, triangle and quarter-circular arc, are exemplified. In particular, a first cutout part formed from an outwardly inclined surface being inclined downward in a radially outward direction is preferred, and a longitudinal cross section of this outwardly inclined surface may be linear or curved.

Further, it is preferred that the packaging container of the present invention has a second cutout part at the upper end of the inner edge of the flange part. As a molten resin can be held in the cutout part, it is possible to suppress the amount of the molten resin being led to the side of the folded corner part of the skirt (the first cutout part side). With regard to the shape and size of the second cutout part at the upper end of the inner edge of the flange part mentioned above, any shape and size can be applied as long as it does not make it impossible to seal the upper surface of the flange with the container cap in relation to the first cutout part mentioned above. For example, as in the case of the first cutout part, cutout parts whose longitudinal cross sections are rectangle, triangle and quarter-circular arc, are exemplified, and it is preferred that it has a same size as or is smaller than the first cutout part. In particular, a second cutout part formed from an inwardly inclined surface being inclined downward in a radially inward direction is preferred, and a longitudinal cross section of this inwardly inclined surface may be linear or curved.

Furthermore, in the packaging container of the present invention, it is preferred that the outwardly inclined surface and the inwardly inclined surface being formed at the upper surface of the flange part are contiguous, and a longitudinal cross section of the outwardly inclined surface and the inwardly inclined surface is formed in a circular arc, or that the outwardly inclined surface and the inwardly inclined surface are formed such that there is a horizontal plane between them. When the longitudinal cross section of the outwardly inclined surface and the inwardly inclined surface is formed in a circular arc, the radius of curvature of the circular arc in the longitudinal cross section of the outwardly inclined surface and the inwardly inclined surface is preferably 1 to 3-fold, more preferably 1.5 to 2.5-fold, as long as the width of the flange. Specifically, in case a container body whose flange width is 2 mm is used, it is effective that the radius of curvature of the circular arc is 2 to 6 mm, and it is particularly effective that the radius of curvature of the circular arc is 3 mm. In addition, when the outwardly inclined surface and the inwardly inclined surface are formed such that there is a horizontal plane between them, generally the width of the horizontal plane is, though it depends on the width of the flange, preferably about 0.1 to 1 mm, more preferably about 0.2 to 0.5 mm.

As mentioned above, because the outwardly inclined surface and the inwardly inclined surface being formed at the upper surface of the flange part are contiguous, and a longitudinal cross section of the outwardly inclined surface and the inwardly inclined surface is formed in a circular arc, or the outwardly inclined surface and the inwardly inclined surface are formed such that there is a horizontal plane between them, in other words, the shape is formed such that the part around the center of the flange part is high, and the height is gradually decreasing towards both ends. Therefore, the sealed part of the container and the cap material are surely adhered in a nearly linear state around the peak of the flange part even if there is a deformation in the flange part. Further, welding is started at the adhered part and the heated and softened part spreads by being subjected to the sealing pressure, resulting that a prescribed sealing width can be stably obtained. In addition, as the height of the both ends of the flange part is low, the sealing pressure decreases at the both ends of the sealed part, which reduces the occurrence of a breakage at the edge.

Further, in the packaging container of the present invention, it is preferred that surface roughening is conducted to a whole or part of the upper surface of the flange part. With regard to a degree of surface roughening, it is surface roughening in which arithmetic average roughness (Ra) as defined in JIS B 0601-1994 is preferably 4 to 20 μm, more preferably 6 to 10 μm, still more preferably 7 to 9 μm. On that occasion, it is more preferred that the mean spacing of profile irregularities (Sm) is 100 to 250. The surface roughness represents the arithmetic average roughness (Ra), the mean spacing of profile irregularities (Sm), as defined in JIS B 0601-1994, measured with a measuring instrument SURFCOM 570A-3DF made by Tokyo Seimitsu Co., Ltd., and the measurement conditions are as follows: measuring speed is 0.3 mm/s, reference length (l) is 2.5 mm, and cutoff value is 2.5 mm.

The geometry of rough surface is not particularly limited and, for example, punctiform, granular, concentric, spiral, and lattice-like ones are exemplified. The rough surface can be constructed, for example, by processing a die such that it has a prescribed geometry and surface roughness. As to methods for processing a die such that it has a rough surface, there is no particular limitation and examples of the methods include sandblast processing, etching processing, honing processing, and laser processing. The sandblast processing is preferred because of the following reasons: a rough surface whose geometry is like a pointed mountain can be obtained; reproducibility is good; a rough surface whose Sm value is 200 μm or less can be obtained; and particularly good sealing property is achieved. Further, surface roughening may be directly conducted to the upper surface of the flange part by lathe turning, mealing, etc. In addition, the laser processing is preferred in the point that it is possible to conduct processing such that the arithmetic average roughness (Ra) mentioned above shows an arbitrary value. Among laser processing techniques, laser microjet processing, wherein water jet and laser are combined, is particularly preferred in the point that burrs do not occur on a processed surface, and a stable rough surface can be obtained.

By conducting surface roughening to a whole or part of the upper surface of the flange part, a sealant resin adheres along the geometry of the rough surface, the anchor effect increases and the suitable seal strength can be obtained even if the sealing energy is small, the easy peeling property is secured, and the drop strength is fulfilled. Further, when the first cutout part (and the second cutout part) mentioned above is provided, and in addition, the surface roughening is conducted, better products can be obtained by a synergistic effect.

The container body in the packaging container of the present invention is not particularly limited as long as it is a synthetic resin container having a flange part at a periphery of an opening at an upper end thereof. It may be a container body wherein the largest outer diameter of the horizontal cross section of the container body is larger than the outer diameter of the horizontal cross section of a flange part, or a container body wherein the largest outer diameter of the horizontal cross section of the container body is smaller than the outer diameter of the horizontal cross section of a flange part. In addition, container bodies with publicly known shapes can be exemplified. Examples of such container bodies include: a tapered container body consisting of a bottom and a tubular body, wherein the diameter of the tubular body tapers from the bottom toward the top, and wherein the diameter of the tubular body tapers from the top toward the bottom, a cylindrical container body which has the same diameter from the top to the bottom, and a container body wherein the above-mentioned shapes are combined. The thickness of the flange part mentioned above is about 0.5 to 2 mm, and the cutout part mentioned above is preferably formed such that its size is about 5 to 25% of the thickness of the flange part.

Though any material can be used as the material of the container body, in case where a container cap is made of a synthetic resin, it is preferred to use the same kind of resin as the container cap, and the one containing, for example, PS (polystyrene)-based resin such as PS resin, AS (styrene-acrylonitrile copolymer) resin, ABS (acrylonitrile-butadiene-styrene copolymer)-based resin, and AXS (terpolymer having acrylonitrile and styrene components) resin; PET-based resin such as unsaturated polyester resin and saturated polyester resin; polyethylene-based resin such as high-density polyethylene, low-density polyethylene, EVA (ethylene-vinyl acetate copolymer) resin, EVOH (ethylene-vinyl alcohol copolymer) resin; polypropylene-based resin; other polyolefin-based resin; polyacetal-based resin; and polycarbonate resin, can be exemplified, or it can be a material containing one or more kinds of these resins. Among them, the ones containing PS-based resin, ABS-based resin and PET-based resin are particularly preferred. Further, additives such as plasticizers, stabilizers, flame retardants, antioxidants, ultraviolet absorbers, colorants, antistatic agents, and subsidiary material additives such as reinforcing agents and filling agents can be appropriately added to these resins.

In addition, as to the container cap mentioned above, there is no particular limitation as long as it is a container cap having a top board part and a skirt part provided such that it is suspended from a periphery of the top board part, and wherein the top board part is heat-sealed onto an upper surface of the flange part of the container body mentioned above. For example, aluminum container caps and synthetic resin container caps are exemplified. In case of synthetic resin container caps, in particular, a cap which has been formed by cold-drawing from a resin sheet for cold forming, the effect of the present invention is obviously seen because the strength of the folded corner part of the skirt is low. In case of synthetic resin container caps, the thickness is about 50 μm to 1 mm, and even if the thickness of a container cap is thin, for example, 300 μm or less, stable sealing can be achieved by the present invention without causing ruptures of the container cap. To a container cap, a groove for sticking a straw may be provided.

With regard to the method for sealing the container bodies with the container caps, there is no particular limitation as long as it is a method wherein heat-sealing is achieved, and examples of such method include ultrasonic sealing, high-frequency sealing, and laser beam sealing, in which the sealing is achieved by heating and melting a resin with the use of the effects of ultrasonic vibration, high-frequency induction, high-frequency dielectricity, and a laser beam. As a breakage at an edge is likely to occur at a folded corner part of a skirt particularly in the ultrasonic sealing in which the sealing is achieved by heat generated by vibration, the present invention is particularly useful for the method.

The cap formed by cold-drawing from a resin sheet for cold forming mentioned above means a cap obtained by forming a resin sheet for cold forming into a cap, with the use of the cap forming device mentioned later, preferably at room temperature or ordinary temperature without heating, or in some cases, under low temperature heating, at a temperature lower than a glass transition point (Tg) of the resin that substantively constitutes the resin sheet. By placing the cap formed by cold-drawing from a resin sheet for cold forming on a synthetic resin container filled with a content, product containers, which are equivalent to those using conventional cap materials wherein an aluminum foil layer is used as a base material, can be obtained.

The resin sheet for cold forming mentioned above is not particularly limited as long as it is a resin sheet that is used to manufacture a synthetic resin cap being fixed to a resin formed product (container body, etc.), and is constituted of a base material layer (single layer body) or a base material layer on which a functional layer is laminated (laminated body), and wherein the resin sheet for cold forming capable of giving a shape retaining property to the resin cap. It can be a single-layer structure constituted only of a base material layer, or a laminated structure wherein a functional layer is laminated on both surfaces or either one of the surfaces of the base material layer. Examples of the above-mentioned functional layer include; a sealant layer having an adhesive function, an antistatic layer having an antistatic function, a barrier layer having a gas penetration blocking function, a printing layer having a display function, and a protection layer having a protection function for the printing layer.

The base material layer of the resin sheet for cold forming is a layer having cold formability which makes it possible to form a secondary processed product having a shape retaining property by a plastic deformation caused by cold forming of the sheet. As for a material of the base material layer, there is no specific limitation and the one containing, for example, PS (polystyrene)-based resin such as PS resin, AS (styrene-acrylonitrile copolymer) resin, ABS (acrylonitrile-butadiene-styrene copolymer)-based resin, and AXS (ter-polymer having acrylonitrile and styrene components) resin; PET-based resin such as unsaturated polyester resin and saturated polyester resin; polyethylene-based resin such as high-density polyethylene, low-density polyethylene, EVA (ethylene-vinyl acetate copolymer) resin, EVOH (ethylene-vinyl alcohol copolymer) resin; polypropylene-based resin; other polyolefin-based resin; polyacetal-based resin; and polycarbonate resin, etc., can be exemplified, or it can be a base material layer containing one or more kinds of these resins. Among them, the one containing PS-based resin, ABS-based resin or PET-based resin is preferred. It is especially preferred that it contains the same kind of resin as the resin formed product as a main component because it is possible to improve recycling efficiency. When the resin formed product contains a polystyrene-based resin, in particular, a high impact polystyrene-based resin as a main component, it is more preferred to contain the same kind of polystyrene-based resin or high impact polystyrene-based resin as a main component. Further, additives such as plasticizers, stabilizers, flame retardants, antioxidants, ultraviolet absorbers, colorants and antistatic agents, and subsidiary material additives such as reinforcing agents and filling agents can be added to these resins appropriately.

As for the above-mentioned polystyrene-based resin contained in the base material layer of the resin sheet for cold forming, so-called general-purpose polystyrene-based resin, rubber-modified polystyrene-based resin and a mixture thereof can be exemplified. The rubber-modified polystyrene-based resin is preferred among them, and a high impact polystyrene-based resin is preferred among the rubber-modified polystyrene-based resins, and especially the one wherein a styrene-butadiene copolymer is mixed and kneaded with the high impact polystyrene-based resin at a prescribed proportion, is more preferred.

The above-mentioned general-purpose polystyrene-based resin is also referred to as "GPPS", and is generally a styrene homopolymer, while the resin used for a base material layer is not limited to a styrene homopolymer. As for a styrene-based monomer of the general-purpose polystyrene-based resin, styrene having one or more substituents such as alkyl groups and phenyl groups can be exemplified besides styrene. Specific examples of the styrene monomer include alkyl-substituted styrene such as α-methylstyrene, α-ethylstyrene, α-n-propylstyrene, α-isopropylstyrene, α-n-butylstyrene, α-t-butylstyrene, o-methylstyrene, m-methylstyrene, p-methylstyrene, o-ethylstyrene, m-ethylstyrene, p-ethylstyrene, o-isopropylstyrene, m-isopropylstyrene, p-isopropylstyrene, o-t-butylstyrene, m-t-butylstyrene, and p-t-butylstyrene. As for a polystyrene-based resin, it can be a homopolymer of these monomers or a copolymer of two or more kinds of them. With regard to the copolymer, it can be any copolymer such as a random copolymer, an alternating copolymer, a block copolymer, a graft copolymer, etc.

In addition, as for the above-mentioned rubber-modified polystyrene-based resin, anything can be used as long as it is so-called high impact polystyrene (HIPS) wherein synthetic rubber is blended with polystyrene. With regard to a blending method, it can be any blending method such as a method wherein rubber and polystyrene, both of which are polymers, are blended together mechanically or mixed together in a latex state, or a method wherein rubber is dissolved in a styrene monomer for polymerization, and a method wherein a styrene-based monomer is polymerized in the presence of a rubber-like polymer is preferred. The high impact polystyrene thus obtained from the method wherein a styrene-based monomer is polymerized in the presence of a rubber-like polymer is a graft copolymer wherein side chains of polystyrene are attached to rubber. The high impact polystyrene has a structure wherein soft component particles are present in a dispersed condition in polystyrene forming a matrix. As for a soft component particle, a particle having a structure generally referred to as "salami structure" or "single occlusion structure", which is a structure wherein polystyrene is occluded to the rubber-like polymer, is preferred, but it is not limited thereto. Further, as for a styrene-based monomer, the same styrene-based monomers as those of the GPPS mentioned above can be exemplified. Examples of the rubber-like polymer include polybutadiene, a styrene-butadiene copolymer and polyisoprene, and among them, a styrene-butadiene copolymer is especially preferred. As for the styrene-butadiene copolymer, SBR-based thermoplastic rubber can be exemplified, and the styrene-butadiene block copolymer having an SB or SBS structure, or SEBS wherein these are fully or partly hydrogenated, etc., can be used as well.

With regard to a rubber-modified polystyrene-based resin contained in the base material layer, the ones containing a composition consisting of only high impact polystyrene, or consisting of high impact polystyrene and a styrene-butadiene copolymer are preferred. Among them, the ones containing a composition consisting of 100 to 70% by weight of high impact polystyrene and 0 to 30% by weight of a styrene-butadiene copolymer are preferred. In particular, the ones containing a composition consisting of 100 to 70% by weight of high impact polystyrene (hereinafter referred to as "high impact polystyrene (A)") that is obtained by polymerizing a styrene-based monomer in the presence of a rubber-like polymer, and has a matrix whose weight-average molecular weight is 150000 to 300000, a styrene content of 82 to 94% by weight, a rubber content of 6 to 15% by weight, and a liquid paraffin content of 0 to 3.0% by weight; and 0 to 30% by weight of a styrene-butadiene copolymer (hereinafter referred to as "styrene-butadiene copolymer (B)") that has a styrene content of 30 to 90% by weight, and a butadiene content of 70 to 10% by weight is preferred, because it makes possible to plastically deform the sheet by cold-forming the sheet, and the secondary formed and processed product (synthetic resin formed cap) obtained by cold-forming the sheet will have an excellent impact resistance, and an excellent shape retaining property as well.

When the rubber content of the above-mentioned high impact polystyrene (A) is 6% by weight or more, preferably 9% by weight or more, the sheet is not ruptured at the time of cold forming. When the rubber content is 15% by weight or less, it becomes easier to plastically deform the sheet by cold forming, resulting that the obtained secondary formed and processed product has a sufficient shape retaining property. Therefore, such rubber content is preferred. Further, the rubber content of a high impact polystyrene can be calculated by a calculating method based on the amount of rubber used at the time of manufacture, or a method for evaluating an analytical curve prepared by infrared absorption spectrometry (IR) method with the use of high impact polystyrene containing a known rubber content as a standard sample.

Furthermore, when a liquid paraffin content of the above-mentioned high impact polystyrene (A) is 3.0% by weight or less, preferably 2.0% by weight or less, it becomes easier to plastically deform the sheet by cold forming, resulting that the obtained synthetic resin formed cap has a sufficient shape retaining property. Therefore, such liquid paraffin content is preferred. As for the liquid paraffin, cycloparaffin such as cyclopentane, cyclohexane, cycloheptane, etc., can be specifically exemplified, and white mineral oil which can be used for food packaging materials (mineral oil being a mixture of alkyl naphthene hydrocarbon and having a weight-average molecular weight of about 300 to 600) can be preferably exemplified.

Among the above-mentioned high impact polystyrenes (A), the one having a matrix whose weight-average molecular weight is in the range of 150000 to 300000, especially 200000 to 250000 is preferred. When the matrix whose weight-average molecular weight is 150000 or more, the synthetic resin formed cap obtained by cold forming becomes a resin cap having more appropriate strength. When the matrix whose weight-average molecular weight is 300000 or less, it becomes easier to plastically deforming the sheet by cold forming, resulting that the obtained synthetic resin formed cap has a sufficient shape retaining property. Therefore, such weight-average molecular weight is preferred. A molecular weight of the matrix of the high impact polystyrene (A) mentioned above can be measured by the following method. In brief, it is a method comprising the steps of: dissolving 1 g of high impact polystyrene in 30 ml of methyl ethyl ketone/methanol mixed solvent (volume ratio: 20/3); then, separating a matrix part and soft component particles which are insoluble components by centrifugation; recovering the supernatant other than the insoluble components by decantation; pouring the collected supernatant gradually into about 500 ml of methanol while stirring to precipitate a polymeric part; separating the polymeric part by filtration, then removing methanol by drying; dissolving the obtained dry sample in tetrahydrofuran such that the concentration is adjusted to be 2 mg/ml, and the molecular weight of the matrix in the dissolution is measured with gel permeation chromatography (GPC). The GPC used is equipped with a differential refractometer (RI detector) as a detector, and the molecular weight can be calculated based on the analytical curve obtained by using commercially available monodisperse polystyrene.

Further, among the above-mentioned high impact polystyrenes (A), the ones wherein the swelling degree of soft component particles contained therein is 30 or less are preferred. When the swelling degree of the soft component particles is 30 or less, it becomes easier to plastically deforming the sheet by cold forming, resulting that the obtained synthetic resin formed cap has a sufficient shape retaining property. The above-mentioned swelling degree can be measured by the following method. In brief, it is the method comprising the steps of: dissolving 0.4 g of high impact polystyrene in 18 ml of toluene and leaving the resultant for 2 hours or more, centrifuging the obtained toluene solution (4500 rpm×2 hours) to separate an insoluble matter, discarding the supernatant, and weighing the insoluble matter. The weight is represented as "a". Next, the insoluble matter is dried in a vacuum dryer, and the weight after drying is represented as "b". The swelling degree can be calculated from "a/b".

Furthermore, among the above-mentioned high impact polystyrenes (A), the ones wherein the average particle diameter of soft component particles contained therein is 0.5 to 10 μm, especially 1 to 5 μm, are preferred. When the average particle diameter of soft component particles contained therein is 0.5 μm or more, preferably 1 μm or more, the sheet is not ruptured at the time of cold forming of the sheet. When it is 10 μm or less, preferably 5 μm or less, it becomes easier to plastically deform the sheet by cold forming, resulting that the obtained synthetic resin formed cap has a sufficient shape retaining property. The average particle diameter of the soft component particles mentioned above can be measured by the following method. In brief, it is a method comprising the steps of: dissolving high impact polystyrene in methyl ethyl ketone such that the concentration is adjusted to about 1%; with a laser diffraction particle size analyzer (SALD-1100; Shimadzu Corporation), exposing this sample solution to the laser beam to detect an image of generated diffraction ray and scattered ray; then the size and the amount of particles are calculated based on the pattern and the intensity of the image. For the average particle diameter, it is possible to use 50% of particle diameter in cumulative volume distribution.

On the other hand, among the above-mentioned styrene-butadiene copolymers (B), the ones whose styrene content is 30 to 90% by weight, and whose butadiene content is 10 to 70% by weight are preferred from the viewpoint that it is possible to add more excellent shape retaining property and impact resistance.

If necessary, various additives, for example, additives such as antioxidants, plasticizers, heat stabilizers, ultraviolet absorbers, light stabilizers, lubricants, die-releasing agents, flame retardants, flame retardant aids, pigments, dyes, carbon black, and antistatic agents can be blended with the base material layer in the resin sheet used, or organic fine particles or inorganic fine particles can be added to the extent that they do not impair the performance of the base material layer. In addition, the thickness of the base material layer in the resin sheet is not particularly limited, and, for example, in case of polystyrene-based resin sheet used for manufacturing a synthetic resin formed cap which needs to be peeled from the resin formed product such as a container with an opening, it is preferred that the thickness is in the range of 50 μm to 1 mm.

The functional layer laminated on either one of the surfaces or both surfaces of the base material layer in the resin sheet used is provided to give various functions which improve adhesiveness, antistatic property, wear resistance, aesthetic property, weather resistance, gas barrier resistant property, etc. Examples of such functional layer include a sealant layer, an antistatic layer, a printing layer, and a barrier layer. The functional layer can be constituted of multiple layers having respective functions, or of one layer having plural functions. As for a resin sheet comprising these functional layers, the followings can be exemplified: the one wherein the sealant layer is laminated on both surfaces or either one of the surfaces of the base material layer; the one wherein the sealant layer and the antistatic layer are laminated on both of the surfaces of the base material layer, respectively; the one wherein the sealant layer is laminated on one surface of the base material layer, and the printing layer and the antistatic layer are sequentially laminated on the other surface of the base material layer; and in addition, the one wherein the barrier layer is laminated between the sealant layer and the base material layer. Moreover, if necessary, additives such as antioxidants, heat stabilizers, ultraviolet absorbers, light stabilizers, flame retardants, mineral oils, external lubricants can be blended with these functional layers appropriately, or organic fine particles or, inorganic fine particles can be added to the extent that they do not impair the performance.

Examples of a method for manufacturing the functional layers such as the sealant layer and the antistatic layer mentioned above include: a method wherein a coating solution containing components appropriate for the respective functions, for example, adhesive components, antistatic agents, etc., is coated on either one of the surfaces or both surfaces of the base material layer, and then dried; and a method wherein a film is manufactured by kneading these components into a raw material of resin, and then laminated. As for a method for coating, methods such as roll coater, knife coater, gravure and knife coater and spraying can be adopted. The surface of the base material layer may be reformed in advance by methods such as a corona discharge treatment method, an ozone treatment method, and a plasma treatment method. Further, as for a functional film for laminating, the ones containing the same kind of resin as the base material layer are preferred. For example, when the base material layer contains the above-mentioned polystyrene-based resin, the one containing GPPS and/or a styrene-butadiene copolymer is preferred.

The sealant layer as the functional layer mentioned above is laminated on both surfaces or either one of the surfaces of the base material layer directly or indirectly in order to adjust the fixed strength between the synthetic resin formed cap formed from a resin sheet and the resin formed product (container body, etc.). When it is necessary to adjust the fixed strength, for example, when it is necessary to peel the synthetic resin formed cap from the resin formed product by fingers, it is preferred to provide the sealant layer. However, when it is not necessary to adjust the fixed strength, for example, when it is a resin cap for which high fixed strength is preferred because the resin formed product and the synthetic resin formed cap are manufactured from the same kind of resin, there is no particular need to provide the sealant layer. The components, the thickness, etc., of the sealant layer can be selected appropriately according to the components of the synthetic resin formed cap and the resin formed product that are fixed via the sealant layer, and a fixing method thereof (for example, physical heat sealing and chemical adhesion, etc). Examples of an adhesive component in chemical adhesion include: starch; glue; dextrin; vinyl-based polymers such as vinyl acetate resins, vinyl chloride resins and acrylic resins; rubber such as natural rubber, chloroprene rubber and butyl rubber; amino resins; epoxy resins; phenol resins; unsaturated polyester; polyurethane; and polyimide. However, physical heat sealing with the sealant film for laminating, which does not need the adjustment of the fixing part, is more preferred than the chemical adhesion with the sealant layer formed by coating the adhesive components. In addition, it is preferred that the thickness of the sealant layer is generally in the range of 10 to 50 μm.

As for a sealant layer used in the case where the sealant film for laminating is used for fixing, for example, in the case where the resin formed product and the synthetic resin formed cap containing a polystyrene-based resin as a main component are ultrasonically welded, a sealant film wherein the same kind of resin as the base material layer is contained as a main component can be preferably exemplified. By blending other thermoplastic resins with the same kind of polystyrene-based resin as the resin formed product or the base material layer, the peel strength can be controlled according to its blended amount. Further, a sealant film mainly constituted of a material which is excellent in adhesiveness, such as a thermoplastic elastomer and an ethylene-based copolymer, can be preferably exemplified. Examples of the above-mentioned ethylene-based copolymer include ethylene-vinyl acetate copolymers and ethylene-unsaturated carboxylic acid ester copolymers. If necessary, various additive components, for example, additives such as antioxidants, heat stabilizers, ultraviolet absorbers, light stabilizers, lubricants, flame retardants, flame retardant aids, antistatic agents, pigments, carbon black, mineral oils, and external lubricants can be blended with the sealant layer. In addition, organic fine particles or inorganic fine particles can be added as well to the extent that they do not impair the sealing function.

The adhesive strength between the sealant layer and the base material layer is preferably 3 N/15 mm in width or more, particularly preferably 5 to 8 N/15 mm in width. In the case where the adhesive strength between the sealant layer and the base material layer is 3 N/15 mm in width or more, when the synthetic resin formed cap fixed to the resin formed product is peeled off by fingers, the occurrence of delamination between the sealant layer and the base material layer can be suppressed, and it is possible to prevent a splinter of the sealant layer, which is peeled in the resin formed product and the cap and caused by delamination between the base material layer and the sealant layer, from adhering to the resin formed product and remaining there. When the adhesive strength is 5 to 8 N/15 mm in width or more, more remarkable effect can be obtained. The adhesive strength can be measured by the following method which conforms to JIS-K6854. In brief, it is a method comprising the steps of: pinching unadhered parts of the base material layer and the sealant layer with chucks respectively with the use of a tensile strength tester; setting the opening of both layers at 180°; pulling the unadhered parts at a pulling speed of 300 mm/min; measuring the load at that time; and the adhesive strength can be calculated by converting the measured load into the load per 15 mm in width of adhesion. Further, when a better peeling property between the resin formed product and the resin cap is required, it is preferred to make the flexibility of the functional layer larger than that of the base material layer, and to make the hardness of the functional layer smaller than that of the base material layer in order to obtain a comfortable peeling property.

The antistatic layer as the functional layer mentioned above is provided in order to make it possible to continuously forming the synthetic resin formed cap from the resin sheet by suppressing frictional electrification. The antistatic layer is laminated usually on the surface opposite to the laminated surface of the sealant layer, directly or indirectly on the base material layer. The sheet comprising the functional layer can prevent situations wherein the synthetic resin formed cap cannot be transferred because of difficulties in taking out/feeding of the synthetic resin formed cap caused as follows: when continuous cold forming is carried out, there occurs friction between the sheet and the die in the die part and the synthetic resin formed cap is significantly electrostatically charged; as a result, the obtained resin cap adheres to the die without being demolded, and thereby the sheet to be fed next, etc., and the resin cap are overlapped, or the resin cap adheres by electrostatic charging to a peripheral part of the die or a chute part, or the resin cap immediately after forming drifts in the air, etc. Such electrostatic charge of the synthetic resin formed cap can be avoided by improving the electroconductivity of the sheet surface and/or improving the sliding property of the sheet surface. As for the improvement of the electroconductivity, it is preferred to adjust the surface resistivity value of the sheet surface measured in conformity to JIS-K6911 to be in the range of $10^6$ to $10^{14}\Omega$. In addition, as for the improvement of the sliding property, it is preferred to adjust the coefficient of static friction of the sheet surface measured in conformity to JIS-K7125 to be in the range of 0.1 to 0.4.

A resin sheet wherein the surface resistivity value of the sheet surface is in the range of 106 to $10^{14}\Omega$ can be manufactured, for example, by coating the sheet surface with surfactants such as antistatic agents and anti-fogging agents, or with electroconductive substances such as hydrophilic macromolecules, as the antistatic layer, or the sheet can be manufactured by kneading antistatic agents or anti-fogging agents into the resin before the resin is formed into a sheet. For example, in case of a polystyrene-based resin sheet, when the antistatic layer is formed by coating the surface of the base material layer of the polystyrene-based resin with the electroconductive substance, etc., coating amount is preferably in the range of 20 to 500 mg/m$^2$. When the surface resistivity value of a polystyrene-based resin sheet is larger than $10^{14}\Omega$, there occurs significant frictional electrification at the time of continuous forming as mentioned above, and it may become difficult to take out/feed the resin cap because it adheres to the die part. In addition, a resin sheet wherein the coefficient of static friction of the sheet surface is in the range of 0.1 to 0.4 can be manufactured, for example, by coating the sheet surface with surface lubricants such as a polysiloxane resin, as the functional layer, or the sheet can be manufactured by kneading surface lubricants, etc., into the resin before the resin is formed into a sheet. When manufacturing a functional layer, the polysiloxane resin can be used in either form of oil or water-based emulsion. When coating, the coating amount is preferably in the range of 0.1 to 50 mg/m$^2$. As mentioned above, by kneading the antistatic agents or surface lubricants, etc., directly into the material resin of the base material layer, it becomes possible for the base material layer to substitute for the antistatic layer with an antistatic effect having a prescribed surface resistivity value and a coefficient of static friction.

The printing layer as the above-mentioned functional layer is provided for the purpose of a product description and surface decoration of the synthetic resin formed cap. It can be provided either on the surface of the base material layer, or between the base material layer and such other functional layer laminated on the base material layer. However, when there is other functional layer on both surfaces or either one of the surfaces of the base material layer, it is preferred that a printing layer is provided between the base material layer and other functional layer in order to avoid omission and damage of the printing surface caused by the friction between the sheet and the die, etc., at the time of cold forming. Examples of a method for forming a printing layer include: a method for forming a printing layer by printing on the surface of the base material layer; a method for forming a printing layer by laminating other functional layer on the printing surface prepared on the surface of the base material layer; a method for forming a printing layer by printing on the backside of the other functional layer manufactured as a film so that it can be used also as the printing layer, and by laminating this film, which acts as the printing layer as well, in such a manner that the printing surface comes into contact with the base material layer; a method for forming a printing layer by using the film on which printing is performed separately as the printing layer, and by laminating this film between the base material layer and other functional layer. Further, the printing layer can be decorated with metallic luster.

The barrier layer as the above-mentioned functional layer is provided in order to add weather resistance, gas barrier property, etc., against light, gas, etc., to the sheet. In the case where the products formed from the sheet are containers, caps of containers, packaging materials, etc., the barrier layer is provided in order to add an aroma retaining function and a function to prevent permeation of water vapor and poisonous gas, so that spoilage of the content can be prevented. The barrier layer is generally manufactured as a gas impermeable film, and when other functional layers are provided on the surface of the base material layer, or provided on both surfaces or either one of the surfaces of the base material layer, it is provided between the other functional layer and the base material layer, for example, between the sealant layer and the base material layer. As for the above-mentioned gas impermeable film, a resin film manufactured from a resin containing a resin component which constitutes the base material layer is preferred. The film may, if necessary, contain an ultraviolet absorber, etc. The thickness of the gas impermeable film that forms the barrier layer is generally in the range of 10 to 100 μm.

As mentioned above, a cold forming process accompanied with the plastic deformation such as forming, bending, shearing and pressing is carried out to the resin sheet for cold forming by pushing the sheet material into the female die by using the male die without heating, generally at room temperature, and pressing the sheet material at high speed. As for a technique to evaluate the plastic deformation of the resin sheet at this point of time as a model, the high speed impact test at room temperature is considered to be effective. From this point of view, it is preferred that the propagation energy and the displacement at maximum load of the resin sheet for cold forming, which are measured by the falling weight impact test method in conformity to ASTM-D3763, have specific values.

For example, in the case where the resin sheet for cold forming contains a polystyrene-based resin, it is preferred that the propagation energy of the sheet which is 150 μm thick, measured by the falling weight impact test method in conformity to ASTM-D3763, is 0.015 J or more, particularly 0.02 J or more. When the propagation energy is 0.015 J or more, the sheet material is plastically deformed sufficiently without rupture, and the obtained synthetic resin formed caps are uniformly shaped with a shape retaining property. When the energy is 0.02 J or more, more remarkable effect can be obtained. The propagation energy of the falling weight impact test described herein refers to the absorbed energy between the displacement at maximum load and the displacement at the rupture in the total absorbed energy needed for the break obtained at the falling weight impact test. In addition, a value obtained by the falling weight impact refers to a value measured with the use of a weight having a holder of 45 mm in diameter and an impact core of 13 mm in diameter, at the rate of fall of the impact core of 5.0 M/sec.

Similarly, in the case where the resin sheet for cold forming contains a polystyrene-based resin, it is preferred that the displacement at maximum load of the sheet which is 150 μm thick, measured by the falling weight impact test method conforming to ASTM-D3763, is 10.0 mm or less, particularly 9.5 mm or less. When the displacement at maximum load is 10.0 mm or less, the sheet material is plastically deformed sufficiently without rupture, and the obtained synthetic resin formed caps are uniformly shaped with a shape retaining property. When the displacement at maximum load is 9.5 mm or less, more remarkable effect can be obtained. The displacement at maximum load in the falling weight impact test described herein refers to the amount of displacement (the amount of displacement between the tip of falling weight and the surface of a test piece of the sheet) at the time of maximum loading. In addition, a value obtained by the falling weight impact refers to a value measured with the use of a weight having a holder of 45 mm in diameter and an impact core of 13 mm in diameter, at the rate of fall of the impact core of 5.0 M/sec.

The resin sheet for cold forming used can be colored, for instance, white-colored. In particular, when the sheet contains a polystyrene-based resin, it is preferred that either one of the base material layer or the functional layer, or both of them are white-colored. When the sheet containing a polystyrene-based resin is formed and processed, a bended part wherein plastic deformation has occurred is whitened. Consequently, when these layers themselves have been white-colored in advance, the whitening of the bended part caused by plastic deformation would be less noticeable. For the white-coloring of these layers, the sheet can be manufactured by adding white pigments and dyes, such as titanium oxide and zinc oxide, to a raw resin in the range of 0.5 to 8% by weight.

The resin sheet for cold forming used can be manufactured by known methods using a sheet extruding device, a press processing device, etc. The sheet can be manufactured as a single base material layer, or a laminated body of the base material layer and one or more functional layers, for example, by a method wherein the base material layer and the functional layer are co-extruded simultaneously by using the sheet extruding device; a method wherein the base material layer and the functional layer are dry-laminated by using a two-component reactive adhesive; a method wherein the base material layer and the functional layer are laminated by thermal lamination; a method wherein the functional layer is extrusion-coated on the base material layer; a method wherein the printing is performed on the base material layer or the functional layer; or by an appropriate combination of these methods.

Further, as a cap forming device using the resin sheet for cold forming mentioned above, for example, the cap forming device described in Japanese Patent Application No. 2004-164366 is exemplified. Specifically, the following is exemplified: the device which comprises: a primary cap forming device (preferably a primary cap cold forming device) for forming a synthetic resin container cap having a top board part and a skirt part provided such that it is suspended from a periphery of the top board part; and a secondary cap forming device for forming a cap of a sealed container, with which the upper surface of the flange part at a periphery of an opening at an upper end of the synthetic resin container body filled with a content is sealed, into a final cap shape, and which has a drawing means or a drawing/twisting means for a cap skirt part of a sealed container. In general, such cap forming device is applied to a filling/packaging machine for filling a content in a container body, placing a cap on the container body filled with the content, and sealing the container body with the cap to make a sealed container. As the filling/packaging machine, the following machine can be preferably exemplified: the filling/packaging machine which comprises: a container feeding device for feeding a container body to a filling device; a filling device for filling a content in a container body fed; a primary cap forming device for forming a synthetic resin container cap having a top board part and a skirt part provided such that it is suspended from a periphery of the top board part, from a sheet-like cap material; a cap feeding device for feeding a formed cap to an opening at an upper end of a container body filled with a content; a sealing device for sealing an opening at an upper end of a container body with a formed cap to make a sealed container; and a secondary cap forming device for forming a cap of a sealed container formed by the primary cap forming device into a final cap shape. The effect of the present invention is more obviously seen by applying the packaging container of the present invention to the cap forming device mentioned above.

Here, the term "final cap shape" means a cap shape substantially same as those of product containers using conventional cap materials using an aluminum foil layer is used as a base material. The term "a drawing means for a cap skirt part of a sealed container" refers a means for drawing or cramping a cap skirt part of a sealed container, and in addition, the term "a drawing/twisting means for a cap skirt part of a sealed container" refers a means for twisting a cap skirt part or a sealed container body while a cap skirt part of a sealed container is being drawn or cramped, or a means for twisting a cap skirt part and a sealed container body in the counter direction while a cap skirt part of a sealed container is being drawn or cramped.

It is preferred that the drawing/twisting means for a cap skirt part of a sealed container has a drawing means having a setting-in hole or a setting-in recess, in which a cap skirt part of a placed sealed container can be set, and a means for twisting a cap skirt part and/or a sealed container body while a cap skirt part is being drawn.

As to the above-mentioned drawing means having a setting-in hole or a setting-in recess, in which a cap skirt part of a placed sealed container can be set, it is preferred that it has a container table for placing a sealed container thereon; a female forming member having a setting-in hole or a setting-in recess, in which a cap skirt part of a sealed container placed on the container table can be set; and an elevating mechanism for moving the container table and/or the female forming member close to or away from each other such that a cap skirt part of a sealed container can be set in/withdrawn from a setting-in hole or a setting-in recess of the female forming member. It is preferred that the above-mentioned female forming member has an extrusion piston which is provided such that it can reciprocate in a cylindrical hollow part of the female forming member, and which has a setting-in hole or a setting-in recess, in which a cap skirt part of a sealed container can be set, at the lower end; and a means for urging the extrusion piston toward an open end of a formed hole. Further, it is preferred that the above-mentioned means for twisting a cap skirt part and/or a sealed container body while a cap skirt part is being drawn is a means for rotating a gear fixed to a piston rod of an extrusion piston with a synchronous belt being wrapped around a plurality of pulleys.

In addition, it is preferred that the cap forming device mentioned above has a heating means for heating a cap skirt part of a sealed container, which is set prior to a drawing step or a drawing/twisting step of a cap skirt part of a sealed container with the use of the pressing means or the drawing/twisting means. For example, it is preferred that the heating means comprises a hot air nozzle for injecting hot air to a cap skirt part of a sealed container and a rotating means for rotating and transferring a sealed container with the use of a longitudinal axis of the sealed container as a rotary axis, and it is more preferred that a hot air cover is provided above the transfer route for rotating and transferring a sealed container.

Further, the filled package of the present invention is not particularly limited as long as it comprises the packaging container mentioned above and a filling being filled in the packaging container. The filling may be a liquid or a solid, and the specific examples include juice, milk beverage, yoghurt, and jelly.

Hereinafter, the present invention is described more specifically with reference to Examples, however, the technical scope of the present invention is not limited to these exemplifications.

FIG. 1 is a longitudinal cross section of the packaging container of the present invention. FIG. 2 is a longitudinal cross section of the vicinity of the flange part of the packaging container shown in FIG. 1. FIG. 3(A) to (C) are a set of longitudinal cross sections of the vicinity of the flange part according to other example. FIG. 4(A) to (C) are a set of views showing examples of a geometry of a rough surface at the upper surface of the flange part. FIG. 5 is an explanatory view for the packaging container shown in FIG. 1 when it is sealed. FIG. 6 is an enlarged view of the flange part of FIG. 5. FIG. 7 is a view showing the unevenness in the thickness of the container body.

As it is shown in FIG. 1, a packaging container 1 according to one embodiment of the present invention is a container comprising: a synthetic resin container body 3 having a flange part 2 at a periphery of an opening at an upper end thereof; and a container cap 6 having a top board part 4 and a skirt part 5 provided such that it is suspended from a periphery of the top board part 4, and whose top board part 4 is heat-sealed onto an upper surface of the flange part 2 of the container body 3. As it is shown in FIG. 2, it has a first cutout part 7 at an upper end of an outer edge of the flange part 2 of the container body 3, and a second cutout part 8 at an upper end of an inner edge thereof.

The container body 3 is an 80 ml container made of polystyrene, and the width of a flange at the flange part 2 is about 2 mm. The first cutout part 7 and the second cutout part 8 provided at the flange part 2 are formed from an outwardly inclined surface 9 being convex curved and an inwardly inclined surface 10 being convex curved, which are successively provided. The longitudinal cross section of the upper surface of the flange part 2 thus formed is in a shape of circular arc, and its radius of curvature is 3 mm. In addition, surface roughening (Ra 7 to 8 μm) is conducted to the entire upper surface of the flange part 2, thereby the improvement of adhesion to the container cap 6 is attempted (see FIG. 5 and FIG. 6).

Here, the first cutout part 7 formed at the upper end of the outer edge of the flange part 2, in addition to the one shown in FIG. 2, may be formed from an outwardly inclined surface 9 being linear and inclined downward in a radially outward direction as shown in FIG. 3 (A), and at that occasion, it is possible to dispose the second cutout part 8 formed from an inwardly inclined surface 10 being inclined downward in a radially inward direction as shown in FIG. 3 (B). In addition, as another example, the first cutout part 7 may be the one wherein the longitudinal cross section of the upper end of the outer edge of the flange part 2 is rectangle as shown in FIG. 3 (C). Further, as the geometry of the rough surface (the upper surface of the flange part 2) which has been subjected to surface roughening, lattice-like, punctiform, and concentric ones, etc., are exemplified as shown in FIGS. 4 (A) to (C).

The container cap 6 is a synthetic resin container cap cold-formed from a multilayered sheet material wherein an easy peel sealant is laminated, and a part at the obverse side 11*a* of a folded corner part of a skirt 11 has been damaged upon the cold-forming, so that the strength is lowered.

In case of sealing the packaging container 1 having the constitution mentioned above, as shown in FIG. 5 and FIG. 6, when sealing pressure is applied to a sealant part 12 of a cap material, which has been heated by a sealing member 13 and softened, the sealant is pushed and a protrusion 14 is formed at the outer surface of the sealed part. However, the occurrence of a breakage at the edge at the folded corner part of the skirt 11 is prevented because the protrusion 14 is away from the folded corner part of the skirt 11, and because the pressure at the folded corner part of the skirt 11 is reduced due to the first cutout part 7, which is downwardly arranged.

Further, as shown in FIG. 7, the wall thickness of the container body 3 is uneven in general, and thereby the reaction force RL of the sealing pressure at a thin-walled part 15 is smaller than the reaction force RH at a thick-walled part 16, resulting that the pressure is regionally weakened. However, in case of the packaging container 1 having the constitution mentioned above, as it is formed such that the central part of the flange part 2 is high, the container body 3 and the container cap 6 are linearly adhered to each other at the central part and stable sealing can be obtained even if there is a deformation in the flange part 2 in addition to the changes in the wall thickness of the container body 3 thus described.

The packaging container of the present invention mentioned above fulfills the drop strength in an erecting state: 80 cm and the drop strength in an inverted state: 40 cm, exhibits no breakages at the edge, and fulfills the peel strength of 7 to 16N.

Hereinafter, a filling/packaging machine to which the packaging container mentioned above can be applied, and a method for sealing packaging containers are specifically described.

In FIG. 8, one embodiment of the filling/packaging machine to which a cap forming device is applied is shown as an overall plan view. As shown in FIG. 8, the filling/packaging machine comprises: a container feeding device A for feeding a synthetic resin bottomed tubular container body to a filling device; a filling device B for filling a content in a container body fed; a primary cap forming device C for forming a synthetic resin formed cap which has a top board part and a skirt part provided such that it is suspended from a periphery of the top board part, from a sheet-like cap material; a cap feeding device D for feeding a formed cap to an opening at an upper end of a container body filled with a content; a sealing device E for sealing an opening at an upper end of a container body with a formed cap to make a sealed container; and a secondary cap forming device F for forming a cap of a sealed container formed by the primary cap forming device into a final cap shape.

The above-mentioned container feeding device A comprises a container setting-up device A-1, a transfer conveyor A-2, and a screw conveyor A-3. In the container setting-up device A-1, bottle-like synthetic resin containers, which have been fed while facing in a random direction, are set up such that an opening at an upper end thereof faces upward, and placed on the transfer conveyor A-2 in a line. The containers placed on the transfer conveyor A-2 are transferred to the downstream side, and aligned in a prescribed pitch by the screw conveyor A-3 at the downstream part of the transfer conveyor. The aligned containers are fed to the filling device B via an inlet star wheel A-4. In the filling device B, the containers are filled with a content while the containers are rotated and moved within the device. The containers filled with the content are transferred to an intermediate star wheel B-8.

In the vicinity of the filling device B of the filling/packaging machine, the primary cap cold forming device C is provided. In the primary cap cold forming device C, a synthetic resin sheet-like cap material S is punched out in a substantial disk-shape, and the punched-put cap material is formed into a substantial U-shape in cross section, that is, formed into a cap P-2 consisting of a top board part P-21 and a skirt part P-22 provided such that it is suspended from a periphery of the top board part (see FIG. 14). The formed cap P-2 is placed on an opening at an upper end of a container being transferred by the intermediate star wheel B-8.

Subsequently, the containers filled with the content and on which caps are placed are fed to the sealing device E. In the sealing device E, the containers are sealed with the caps while the containers are moved within the device. The sealed containers are placed on a transfer conveyor F-4. The containers placed on the transfer conveyor F-4 are transferred to the downstream side, and aligned in a prescribed pitch by a screw conveyor F-3 at the downstream part of the transfer conveyor. The aligned containers are fed to the secondary cap forming device F via an inlet star wheel F-5. In the secondary cap forming device F, the caps with which the containers are sealed are secondarily formed to make containers of final shape while the containers are moved within the device. The containers of final shape are discharged onto the transfer conveyor F-4 via an outlet star wheel F-7.

In FIG. 9, a longitudinal cross section of the filling device B is shown. As shown in FIG. 9, the filling device B has: a filling liquid tank B-1, which is a circular shape in a plan view; and a prescribed number of filling nozzles B-2 provided downward and at even intervals on the undersurface of a peripheral part of the filling liquid tank; a container placing table B-3 provided below the filling nozzles, at a position corresponding to the filling nozzles; and a turntable B-4 equipped with the container placing table B-3. The turntable B-4 and the filling liquid tank B-1 are fixed to a drive shaft of filling device B-5, and rotated in an integrated manner by the drive shaft B-5. The container placing table B-3 is constituted of: a fixed part B-31, which is fixed to the turntable B-4 and extended upward from the turntable; and a tubular move part with a closed upper end B-32, which is placed over the fixed part B-31 such that it is vertically slidable, and whose upper end is closed with a top surface. The move part B-32 is urged upward by a spring B-33 provided upward in the middle of the fixed part B-31. A roller shaft B-34 is provided outwardly at the outer side of the lower part of the move part B-32, and a rotatable roller B-35 is provided at the roller shaft B-34. A cam B-6 which abuts the roller B-35 and controls the position of the move part B-32 is provided at the outer side of the container placing table B-3. A container holder B-7, whose horizontal cross section is substantially U-shaped, is provided at the top surface of the move part B-32, thereby positioning a container body P-1 from the inner side thereof. A guide, which is not shown, is provided at the outer side of the container holder B-7, along the container transfer route, and it is constituted such that containers positioned by the container holder B-7 are guided and transferred along the guide.

When the container body P-1 is transferred to the container sending-in position, the move part B-32 of the container placing table B-3 has been pushed down by the cam B-6, and the top surface of the move part B-32 has descended to the level where the container P-1 can be placed thereon. When the container body P-1 is placed on the container placing table B-3 and begins to be rotated and moved within the filling device B, the move part B-32 of the container placing table B-3 is gradually set free from the positioning control by the cam B-6, and moved upward by the urging force of the spring B-33. The container on the container placing table B-3 is pressed against the filling nozzle B-2 by the urging force of the spring B-33. A filling valve of the filling nozzle B-2 is set free by pressing the container body P-1 against the filling nozzle B-2, a filling liquid is filled in the container. When the filling is finished, the move part B-32 of the container placing table B-3 is gradually pushed down by the cam B-6 to the level where the container body P-1 can be transferred to the intermediate star wheel B-8. The container body P-1 is transferred to the intermediate star wheel B-8 at the container sending-out position.

In FIG. 10, the whole of the primary cap cold forming device C is shown, and in FIG. 11, a sheet-like cap material S is shown. As shown in FIG. 10, the primary cap cold forming device C comprises a roll of cap material C-1, an automatic cap material feeding device C-2, a half-cutting device C-3, a cap punching-out and forming device C-4, and a recovery roll C-5. The synthetic resin sheet-like cap material S, which is rolled, is guided to the half-cutting device C-3 via the automatic cap material feeding device C-2. The half-cutting device C-3 forms a substantially U-shaped groove S-1 on the sheet-like cap material S by a laser C-31 as shown in FIG. 11. The groove S-1 secures an openability at the time of sticking a straw into the cap P-2 of the container. In FIG. 11, S-2 and S-3 indicate a proposed line for punching out a cap, and a hole made by punching out a cap, respectively. The sheet-like cap material S wherein the groove S-1 is formed by the half-cutting device C-3 is guided to the cap punching-out and forming device C-4 shown in FIG. 12.

FIG. 12 shows a cross section of the cap punching-out and forming device C-4 which comprises: a cap material punching out means for punching out one or more cap materials from the sheet-like cap material S, which is provided with a movable blade (male blade) C-41, a fixed blade (female blade) C-42, and a holding member C-43 for the sheet-like cap material S; and a cap forming means having a forming die C-44 wherein a plurality of grooves C-441 is provided on the inner circumferential surface thereof (see FIG. 13), a cap pushing-back piston C-45 provided in the forming die C-44, and a former C-48 formed at the end of an operating rod for reciprocating former C-47. When the sheet-like cap material S is intermittently fed downward from up above and a part to be punched out reaches the position corresponding to the forming die C-44, the movable blade C-41 advances, one or more substantially disk-shaped cap materials are punched out from the sheet-like cap material S in cooperation with the fixed blade C-42, and the punched-out cap is formed such that its cross section is substantially U-shaped. At this point, the apical surface of the former C-48 has advanced to contact the packaging material S, and after punching out, it further advances to a prescribed position to push the cap pushing-back piston C-45. As the former C-48 advances, the cap pushing-back piston C-45 goes back against the force of a spring C-451. Consequently, a part of a cap material located outside the inner diameter of the forming die C-44 (a part that forms a skirt part P-22 of a cap P-2) is folded at a folded part P-23, and slid while being held by being pinched between the inner circumferential surface of the forming die C-44 where the grooves C-441 are provided and the outer circumferential surface of the former C-48, and folds are guided to the skirt part P-22 of the cap by a plurality of grooves C-441 provided on the inner circumferential surface of the forming die C-44, so that the cap P-2 consisted of a cap body (flat part) P-21 and the skirt part P-22 (see FIG. 14) is formed. After the cap is formed, as the former C-48 returns to its initial position, the piston C-45 is advanced by repulsion of the spring C-451 to push back the formed cap P-2. The caps P-2, which are pushed-back and formed such that its cross section is substantially U-shaped, are dropped onto the cap feeding device (chute) D located below, and the caps are placed one by one on the openings at the upper ends of the containers P-1 being transferred by the intermediate star wheel B-8. The sheet-like cap material wherein caps have been punched out is recovered by the recovery roll C-48. As described above, the cap punching-out and forming device C-4 is not equipped with a heating mechanism, and is capable of forming caps by causing plastic deformation to a resin sheet-like cap material by cold forming.

The containers filled with the content and on which caps are placed are subsequently fed to the sealing device E. An overall cross section, which is one embodiment of the sealing device E, is shown as FIG. 15. This sealing device E comprises: an upper turntable E-2 wherein a prescribed number of ultrasonic sealing devices E-1 is provided in a fixed condition at the peripheral part thereof at even intervals, and a lower turntable E-4 wherein a container table E-3 is provided in a fixed condition at the corresponding position below the ultrasonic sealing device. The upper turntable E-2 and the lower turntable E-4 are fixed to a drive shaft of sealing device E-5. Above the ultrasonic sealing device E-1, a controlling device E-6 of the sealing device E is provided. The ultrasonic sealing device E-1 comprises a sealing device body E-11 provided in a fixed condition at the upper turntable E-2, and a round-bar-shaped horn E-12 which projects downward from the sealing device body E-11 and has a sealing action face at its lower end, and an oscillator, which is not shown, is built into the sealing device body E-11. The oscillation is conducted to the sealing action face of the horn E-12 by the oscillator. Due to the elevation of the container table E-3, caused by the same mechanism as the elevating mechanism in the container placing table B-3 in the filling device B mentioned above, the container P on the container table is pressed against the sealing action face at the lower end of the horn E-12 of the ultrasonic sealing device E-1, resulting that the container body P-1 and the cap P-2 are heat-sealed.

The secondary cap forming device F of the present invention is described in FIGS. 16 to 20. FIG. 16 is a plan view of the secondary cap forming device F, and FIG. 17 is a longitudinal cross section of the secondary cap forming device body in the secondary cap forming device F. In addition, FIG. 21 (*a*) shows cross sections of a cap and a container body which have been primarily formed before sealing, (b) shows cross sections of a cap and a container body which have been primarily formed after sealing, and (c) shows cross sections of a cap and a container body after they are secondarily formed.

The secondary cap forming device F has a heating means for heating the cap skirt P-22 sealed at the upper end of the sealed container, a rotating means for rotating the container at the position for heating container caps by the heating means with the use of a longitudinal axis of the container as a rotary axis, and a secondary cap forming device body F-1 for secondarily forming the cap of the container. The heating means comprises a pipe-like hot air nozzle F-2 provided along the cap skirt of the container being transferred, before it is sent into the secondary cap forming device body. The rotating means rotates the container by a difference in transfer speed between a screw conveyor F-3 and a transfer conveyor F-4. The secondary cap forming device body F-1 has an upper turntable F-12 and a lower turntable F-13 which are fixed to a drive shaft F-11 of the secondary cap forming device F. In the lower turntable F-13, the container table F-131 for placing a plurality of containers is provided at the peripheral part thereof at even intervals, and at the upper part of the container table F-131, the container holder F-132 is fixed. In the upper turntable F-12, a forming means having a forming hole, into which the upper end of the sealed container P placed on the container table F-131 can be inserted, is provided at the corresponding position above the container table F-131. The container table F-131 has the same elevating mechanism as that of the filling device B and the sealing device E mentioned above.

The sealed container P on a transfer belt F-41 which have been transferred by the transfer conveyor F-4 is first aligned at a prescribed pitch by the screw conveyor F-3. The aligned sealed container P is fed to the secondary cap forming device body F-1 by a recess of an inlet star wheel F-5 and a guide F-6. The pipe-like hot air nozzle F-2 is provided at a position along the cap skirt P-22 of the sealed container P being transferred, from the screw conveyor F-3 to the inlet star wheel F-5. In the hot air nozzle F-2, a hot air blowout hole faced to the cap skirt P-22 is provided. The cap skirt P-22 of the container is heated by hot air blown out from the hot air blowout hole. There is a difference in transfer speed between the transfer conveyor F-4 and the screw conveyor F-3, and by this difference in speed, the sealed container P being aligned on the screw conveyor F-3 is rotated. The sealed container P being transferred on the inlet star wheel F-5 is also rotated by the friction resistance to the guide F-6. By this rotation of the sealed container P, the circumferential surface of the cap skirt P-22 of the container as a whole can be uniformly heated. In FIGS. 16 and 18, the hot air nozzle F-2 is provided only at the left side of the container transferring direction, however, it is preferred to provide it on both sides when improving the ability (increasing the speed) of the filling/packaging machine. In addition, it is more preferred to provide a hot air cover (illustration is omitted) above the container transferring route from the screw conveyor F-3 to the inlet star wheel F-5.

FIG. 19 is an enlarged cross section of a forming and processing part F-14 of a forming means. The forming and processing part F-14 has a tubular female die F-141 wherein a forming hole is formed, and an extrusion piston F-142 which is provided such that it can slide into the forming hole, and which has a setting-in recess, in which a cap skirt P-22 part can be set, at the lower end. A spring holder F-143 is fixed to the other end of the tubular female die F-141, and the extrusion piston F-142 is urged to one open end side of the forming hole by a spring F-144 abutting the spring holder F-143. To the extrusion piston F-142, a piston rod F-145 which pass through the spring holder F-143 and extends to the other end side of the tubular female die F-141 is connected. To the tip end of the piston rod F-145, a stopper F-146 and a gear F-147 are fixed. The extrusion piston F-142 being urged to one end side of the forming hole can be stopped in the vicinity of the open end of the forming hole by the stopper F-146.

FIG. 20 is an enlarged cross section near one end of the forming hole. On the face of the extrusion piston F-142 which abuts the cap skirt P-22 part, a setting-in recess F-148 is formed as mentioned above, the cap skirt P-22 part is set in the setting-in recess F-148 whose diameter is smaller than that of the forming hole, and the cap skirt P-22 part is set in the setting-in recess of the extrusion piston F-142 by the abutting of the top surface of the cap on the abutting face, which is a bottom of the setting-in recess of the extrusion piston.

The secondary cap forming device body F-1 comprises a forming auxiliary part F-15 having a synchronous belt F-153 which is wrapped around one driving pulley F-151 and two driven pulleys F-152 (see FIG. 16), and is arranged such that the gear F-147 engages with the synchronous belt F-153, which is continuously rotated clockwise in a plan view, at a prescribed position in the transfer circumferential route of the gear F-147 mentioned above.

Next, the secondary cap forming and processing is hereinafter described. The sealed containers P, wherein the circumferential surface of the cap skirt P-22 is heated, are sequentially placed on the container table F-131. The sealed container P on the container table is gradually elevated by the elevating mechanism mentioned above. It is constituted such that: the cap skirt P-22 of the elevated sealed container P is pushed and set in the forming hole formed by the tubular female die F-141; and when the container table F-131 reaches the ascent limit, the upper surface of the cap P-21 abuts the bottom of the setting-in recess F-148 of the extrusion piston F-142, the heated cap skirt P-22 part is set in the setting-in recess F-148 of the extrusion piston F-142 to apply a drawing force to the cap skirt P-22 part, and in addition to that, the gear F-147 is rotated by the driving force of the synchronous belt F-153, and thereby the extrusion piston F-142 is rotated through the piston rod F-145. By the rotation of the extrusion piston F-142, a rotating force acts on the sealed container P. However, because the rotation of the container body P-1 is limited by the container holder F-132 mentioned above, a twisting force is applied while the cap skirt P-22 part with which the container body P-1 is sealed is being cramped by the setting-in. As described above, the secondary forming of the caps is secured by the cooperation of the drawing force and the twisting force, and as shown in FIG. 21 (*c*), the secondary forming of the caps is completed and final formed products are obtained. After the completion of the secondary forming, the container table F-131 descends, the cap P-2 is pushed out from the forming hole by the extrusion piston F-142, and the sealed container P on the container table is discharged onto the transfer conveyor F-4 via the outlet star wheel F-7.

INDUSTRIAL APPLICABILITY

The packaging container of the present invention makes it possible to achieve stable sealing while preventing a rupture of a container cap, and to achieve easy and secure opening, as well. In addition, it is possible to provide a packaging container capable of making seal strength and easy openability compatible even if there occurs unevenness in the wall thickness of a bottom wall and a body wall of a container body. Further, even when a cap which has been formed by cold-draw-forming is used, it is possible to provide a packaging container being free from the following problems: a folded corner part of a skirt is ruptured and a hole is made; and the rupture strength of a folded corner part of a skirt significantly weakens.

The invention claimed is:

1. A packaging container comprising:

a synthetic resin container body having an upper end with an opening and a flange part surrounding a periphery of the opening at the upper end and having an upper surface;

a synthetic resin container cap covering the opening, the container cap having a top board part with a lower surface and a folded corner part surrounding the flange part to present a skirt part suspended from a periphery of the top board part, wherein the lower surface of the top board part is arranged to be directly heat sealed to the upper surface of the flange part, wherein the container cap with the folded corner part is cold-drawn from a resin sheet for cold forming and the lower surface of the container cap includes a meltable sealant resin layer;

wherein the flange part includes an upper end with 1) an outer upper edge surface inclined downward and radially outward and 2) an inner upper edge surface inclined downward and radially inward, the outer and inner upper edge surfaces each having a longitudinal cross section that is a curved line.

2. The packaging container according to claim 1, wherein the outer upper edge surface and the inner upper edge surface are contiguous in a region having a further longitudinal cross section that is in a circular arc.

3. The packaging container according to claim 2, wherein a radius of curvature of the circular arc is 1 to 3-fold of the width of the flange.

4. The packaging container according to claim 1, wherein the flange part includes a horizontal plane surface between the outer upper edge surface and the inner upper edge surface.

5. The packaging container according to claim 1, wherein the upper surface of the flange part includes a surface roughening on a whole or part of the upper surface of the flange part.

6. The packaging container according to claim 5, wherein the surface roughening has an arithmetic average roughness (Ra) as defined in JIS B 0601-1994 of 4 to 20 μm.

7. The packaging container according to claim 1, wherein the meltable sealant resin layer is meltable by ultrasound to form a heat seal.

8. The packaging container according to claim 1, wherein the thickness of the container cap is 50 μm to 1 mm.

9. A filled package comprising the packaging container according to claim 1, and a filling being filled in the packaging container.

* * * * *